US010174392B2

(12) United States Patent
Haga et al.

(10) Patent No.: US 10,174,392 B2
(45) Date of Patent: Jan. 8, 2019

(54) METHOD FOR PRODUCING COLD-ROLLED STEEL SHEET

(75) Inventors: Jun Haga, Osaka (JP); Takuya Nishio, Osaka (JP); Masayuki Wakita, Osaka (JP); Yasuaki Tanaka, Osaka (JP); Norio Imai, Osaka (JP); Toshiro Tomida, Osaka (JP); Mitsuru Yoshida, Osaka (JP); Kengo Hata, Osaka (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 869 days.

(21) Appl. No.: 14/130,568

(22) PCT Filed: Jul. 2, 2012

(86) PCT No.: PCT/JP2012/066878

§ 371 (c)(1),
(2), (4) Date: Mar. 28, 2014

(87) PCT Pub. No.: WO2013/005714

PCT Pub. Date: Jan. 10, 2013

(65) Prior Publication Data

US 2014/0238557 A1 Aug. 28, 2014

(30) Foreign Application Priority Data

Jul. 6, 2011 (JP) ..... 2011-150241
Jul. 6, 2011 (JP) ..... 2011-150242
(Continued)

(51) Int. Cl.

| | |
|---|---|
| ***C21D 8/02*** | (2006.01) |
| ***C22C 38/00*** | (2006.01) |
| ***C22C 38/02*** | (2006.01) |
| ***C22C 38/04*** | (2006.01) |

(Continued)

(52) U.S. Cl.
CPC ..... *C21D 8/0236* (2013.01); *C21D 8/0247* (2013.01); *C21D 8/0273* (2013.01);
(Continued)

(58) Field of Classification Search
CPC ..... C21D 8/0236; C21D 8/0247
See application file for complete search history.

(56) References Cited

U.S. PATENT DOCUMENTS 7,455,736 B2 * 11/2008 Kashima ..... C21D 1/20 148/320
2005/0081966 A1 4/2005 Kashima et al.
(Continued)

FOREIGN PATENT DOCUMENTS

EP 2 180 075 4/2010
JP 58-123823 7/1983
(Continued)

*Primary Examiner* — Veronica F Faison
(74) *Attorney, Agent, or Firm* — Clark & Brody

(57) ABSTRACT

A method for producing a high-tensile cold-rolled steel sheet includes subjecting a slab having a composition containing C: more than 0.020% and less than 0.30%, Si: more than 0.10% and 3.00% or less, and Mn: more than 1.00% and 3.50% or less to hot rolling wherein the roll draft of the final one pass is higher than 15%, and rolling is finished in the temperature region of $Ar_3$ point or higher, optionally annealing wherein the hot-rolled steel sheet is heated to 300° C. or higher after being cooled to 780° C. or lower, coiling higher than 400° C. or lower than 400° C., cold rolling the hot-rolled steel sheet or the annealed steel sheet, and annealing wherein the cold-rolled steel sheet is soaked in the temperature region of ($Ac_3$ point−40° C.) or higher, cooling to 500° C. or lower and 300° C. or higher, and holding in that temperature region for 30 seconds or longer.

14 Claims, 1 Drawing Sheet

(30) Foreign Application Priority Data

Jul. 6, 2011 (JP) ..... 2011-150243
Jul. 6, 2011 (JP) ..... 2011-150244
Jul. 6, 2011 (JP) ..... 2011-150247
Jul. 6, 2011 (JP) ..... 2011-150248

(51) Int. Cl.
*C22C 38/06* (2006.01)
*C22C 38/12* (2006.01)
*C21D 8/12* (2006.01)

(52) U.S. Cl.
CPC ..... *C21D 8/1261* (2013.01); *C22C 38/001* (2013.01); *C22C 38/02* (2013.01); *C22C 38/04* (2013.01); *C22C 38/06* (2013.01); *C22C 38/12* (2013.01); *C21D 2211/003* (2013.01)

(56) References Cited

U.S. PATENT DOCUMENTS

2006/0137769 A1* 6/2006 Yuse ..... C22C 38/02 148/320
2011/0186189 A1* 8/2011 Futamura ..... B32B 15/013 148/622
2013/0259734 A1* 10/2013 Kakiuchi ..... C21D 8/0426 420/84
2014/0087208 A1* 3/2014 Toda ..... C21D 8/0236 428/659
2015/0000796 A1* 1/2015 Kakiuchi ..... C22C 38/005 148/504

FOREIGN PATENT DOCUMENTS

| | | |
|---|---|---|
| JP | 59-229413 | 12/1984 |
| JP | 11-061326 | 3/1999 |
| JP | 11-152544 | 6/1999 |
| JP | 2001-192768 | 7/2001 |
| JP | 2005-179703 | 7/2005 |
| JP | 2005-213595 | 8/2005 |
| JP | 2008-007854 | 1/2008 |
| JP | 2010-065272 | 3/2010 |
| JP | 2010-077512 | 4/2010 |
| JP | 2011-140686 | 7/2011 |
| WO | 2007/015541 | 2/2007 |

* cited by examiner

METHOD FOR PRODUCING COLD-ROLLED STEEL SHEET

TECHNICAL FIELD

The present invention relates to a method for producing a cold-rolled steel sheet. More particularly, it relates to a method for producing a cold-rolled steel sheet that is used in various shapes formed by press forming or the like process, especially, a high-tensile cold-rolled steel sheet that is excellent in ductility, work hardening property, and stretch flanging property.

BACKGROUND ART

In these days when the industrial technology field is highly fractionalized, a material used in each technology field has been required to deliver special and high performance. For example, for a cold-rolled steel sheet that is worked by press forming and put in use, more excellent formability has been required with the diversification of press shapes. In addition, as a high strength has been required, the use of a high-tensile cold-rolled steel sheet has been studied. In particular, concerning an automotive steel sheet, in order to reduce the vehicle body weight and thereby to improve the fuel economy from the perspective of global environments, a demand for a high-tensile cold-rolled steel sheet having thin-wall high formability has been increasing remarkably. In press forming, as the thickness of steel sheet used is smaller, cracks and wrinkles are liable to occur. Therefore, a steel sheet further excellent in ductility and stretch flanging property is required. However, the press formability and the high strengthening of steel sheet are characteristics contrary to each other, and therefore it is difficult to satisfy these characteristics at the same time.

As a method for improving the press formability of a high-tensile cold-rolled steel sheet, many techniques concerning grain refinement of micro-structure have been proposed. For example, Patent Document 1 discloses a method for producing a very fine grain high-strength hot-rolled steel sheet that is subjected to rolling at a total draft of 80% or higher in a temperature region in the vicinity of $Ar_3$ point in the hot-rolling process. Patent Document 2 discloses a method for producing an ultrafine ferritic steel that is subjected to continuous rolling at a draft of 40% or higher in the hot-rolling process.

By these techniques, the balance between strength and ductility of hot-rolled steel sheet is improved. However, the above-described Patent Documents do not at all describe a method for making a fine-grain cold-rolled steel sheet to improve the press formability. According to the study conducted by the present inventors, if cold rolling and annealing are performed on the fine-grain hot-rolled steel sheet obtained by high reduction rolling being a base metal, the crystal grains are liable to be coarsened, and it is difficult to obtain a cold-rolled steel sheet excellent in press formability. In particular, in the manufacturing of a composite-structure cold-rolled steel sheet containing a low-temperature transformation producing phase or retained austenite in the metallic structure, which must be annealed in the high-temperature region of $Ac_1$ point or higher, the coarsening of crystal grains at the time of annealing is remarkable, and the advantage of composite-structure cold-rolled steel sheet that the ductility is excellent cannot be enjoyed.

Patent Document 3 discloses a method for producing a hot-rolled steel sheet having ultrafine grains, in which method, rolling reduction in the dynamic recrystallization region is performed with a rolling reduction pass of five or more stands. However, the lowering of temperature at the hot-rolling time must be decreased extremely, and it is difficult to carry out this method in a general hot-rolling equipment. Also, although Patent Document 3 describes an example in which cold rolling and annealing are performed after hot rolling, the balance between tensile strength and bore expandability is poor, and the press formability is insufficient.

Concerning the cold-rolled steel sheet having a fine structure, Patent Document 4 discloses an automotive high-strength cold-rolled steel sheet excellent in collision safety and formability, in which retained austenite having an average crystal grain size of 5 μm or smaller is dispersed in ferrite having an average crystal grain size of 10 μm or smaller. The steel sheet containing retained austenite in the metallic structure exhibits a large elongation due to transformation induced plasticity (TRIP) produced by the martensitizing of austenite during working; however, the bore expandability is impaired by the formation of hard martensite. For the cold-rolled steel sheet disclosed in Patent Document 4, it is supposed that the ductility and bore expandability are improved by making ferrite and retained austenite fine. However, the bore expanding ratio is at most 1.5, and it is difficult to say that sufficient press formability is provided. Also, to enhance the work hardening index and to improve the collision safety, it is necessary to make the main phase a soft ferrite phase, and it is difficult to obtain a high tensile strength.

Patent Document 5 discloses a high-strength steel sheet excellent in elongation and stretch flanging property, in which the secondary phase consisting of retained austenite and/or martensite is dispersed finely within the crystal grains. However, to make the secondary phase fine to a nano size and to disperse it within the crystal grains, it is necessary to contain expensive elements such as Cu and Ni in large amounts and to perform solution treatment at a high temperature for a long period of time, so that the rise in production cost and the decrease in productivity are remarkable.

Patent Document 6 discloses a high-tensile hot dip galvanized steel sheet excellent in ductility, stretch flanging property, and fatigue resistance property, in which retained austenite and low-temperature transformation producing phase are dispersed in ferrite having an average crystal grain size of 10 μm or smaller and in tempered martensite. The tempered martensite is a phase that is effective in improving the stretch flanging property and fatigue resistance property, and it is supposed that if grain refinement of tempered martensite is performed, these properties are further improved. However, in order to obtain a metallic structure containing tempered martensite and retained austenite, primary annealing for forming martensite and secondary annealing for tempering martensite and further for obtaining retained austenite are necessary, so that the productivity is impaired significantly.

Patent Document 7 discloses a method for producing a cold-rolled steel sheet in which retained austenite is dispersed in fine ferrite, in which method, the steel sheet is cooled rapidly to a temperature of 720° C. or lower immediately after being hot-rolled, and is held in a temperature range of 600 to 720° C. for 2 seconds or longer, and the obtained hot-rolled steel sheet is subjected to cold rolling and annealing.

Patent Document

Patent Document 1: JP 58-123823 A1
Patent Document 2: JP59-229413 A1

Patent Document 3: JP 11-152544 A1
Patent Document 4: JP 11-61326 A1
Patent Document 5: JP 2005-179703 A1
Patent Document 6: JP 2001-192768 A1
Patent Document 7: WO2007/15541 A1

SUMMARY OF INVENTION

The above-described technique disclosed in Patent Document 7 is excellent in that a cold-rolled steel sheet in which a fine grain structure is formed and the workability and thermal stability are improved can be obtained by a process in which after hot rolling has been finished, the work strain accumulated in austenite is not released, and ferrite transformation is accomplished with the work strain being used as a driving force.

However, due to needs for higher performance in recent years, a cold-rolled steel sheet provided with a high strength, good ductility, excellent work hardening property, and excellent stretch flanging property at the same time has come to be demanded.

The present invention has been made to meet such a demand. Specifically, an objective of the present invention is to provide a method for producing a high-tensile cold-rolled steel sheet having excellent ductility, work hardening property, and stretch flanging property, in which the tensile strength is 780 MPa or higher.

The present inventors performed detailed investigations of the influence of chemical composition and manufacturing conditions exerted on the mechanical properties of a high-tensile cold-rolled steel sheet. In this description, symbol "%" indicating the content of each element in the chemical composition of steel means mass percent.

A series of sample steels had a chemical composition consisting, in mass percent, of C: more than 0.020% and less than 0.30%, Si: more than 0.10% and 3.00% or less, Mn: more than 1.00% and 3.50% or less, P: 0.10% or less, S: 0.010% or less, sol.Al: 2.00% or less, and N: 0.010% or less.

A slab having the above-described chemical composition was heated to 1200° C., and thereafter was hot-rolled so as to have a thickness of 2.0 mm in various rolling reduction patterns in the temperature range of $Ar_3$ point or higher. After being hot-rolled, the steel sheets were cooled to the temperature region of 780° C. or lower under various cooling conditions. After being air-cooled for 5 to 10 seconds, the steel sheets were cooled to various temperatures at a cooling rate of 90° C./s or lower. This cooling temperature was used as the coiling temperature. After the steel sheets had been charged into an electric heating furnace held at the same temperature and had been held for 30 minutes, the steel sheets were furnace-cooled at a cooling rate of 20° C./h, whereby the gradual cooling after coiling was simulated. Some of the hot-rolled steel sheets thus obtained were heated to various temperatures, and thereafter were cooled, whereby hot-rolled and annealed steel sheets were obtained. The hot-rolled steel sheets or the hot-rolled and annealed steel sheets were subjected to pickling and cold-rolled at a draft of 50% so as to have a thickness of 1.0 mm. Using a continuous annealing simulator, the obtained cold-rolled steel sheets were heated to various temperatures and held for 95 seconds, and thereafter cooled to obtain annealed steel sheets.

From each of hot-rolled steel sheets, hot-rolled and annealed steel sheets, and annealed steel sheets, a test specimen for structure observation was sampled. By using a scanning electron microscope (SEM) equipped with an optical microscope and an electron backscatter diffraction pattern (EBSP) analyzer, the metallic structure was observed at a position deep by one-fourth of thickness from the surface of steel sheet, and by using an X-ray diffractometry (XRD) apparatus, the volume ratio of retained austenite was measured at a position deep by one-fourth of thickness from the surface of annealed steel sheet. Also, from the annealed steel sheet, a tensile test specimen was sampled along the direction perpendicular to the rolling direction. By using this tensile test specimen, a tension test was conducted, whereby the ductility was evaluated by total elongation, and the work hardening property was evaluated by the work hardening index (n value) in the strain range of 5 to 10%. Further, from the annealed steel sheet, a 100-mm square bore expanding test specimen was sampled. By using this test specimen, a bore expanding test was conducted, whereby the stretch flanging property was evaluated. In the bore expanding test, a 10-mm diameter punched hole was formed with a clearance being 12.5%, the punched hole was expanded by using a cone-shaped punch having a front edge angle of 60°, and the expansion ratio (bore expanding ratio) of the hole at the time when a crack penetrating the sheet thickness was generated was measured.

As the result of these preliminary tests, the findings described in the following items (A) to (I) were obtained.

(A) If the hot-rolled steel sheet, which is produced through a so-called immediate rapid cooling process where rapid cooling is performed by water cooling immediately after hot rolling, specifically, the hot-rolled steel sheet is produced in such a way that the steel is rapidly cooled to the temperature region of 780° C. or lower within 0.40 second after the completion of hot rolling, is cold-rolled and annealed, the ductility and stretch flanging property of annealed steel sheet are improved with the rise in annealing temperature. However, if the annealing temperature is too high, the austenite grains are coarsened, and the ductility and stretch flanging property of annealed steel sheet may be deteriorated abruptly.

(B) By controlling the hot-rolling conditions, the grains each having a bcc structure and the grains each having a bct structure (hereinafter, these grains are also generally called "bcc grains") in the hot-rolled steel sheet or the hot-rolled and annealed steel sheet, which is obtained by annealing the said hot-rolled steel sheet, (in the present invention, the hot-rolled steel sheet subjected to annealing is referred to as a "hot-rolled and annealed steel sheet") are made fine, which restrains the coarsening of austenite grains that may occur when annealing is performed at high temperatures after cold rolling. The reason for this is unclear; however, it is presumed to be attributable to the fact that, since the crystal grain boundary of bcc grains functions as a nucleation site of austenite on account of transformation at the annealing time after cold rolling, the nucleation frequency is raised by the refinement of bcc grains, and even if the annealing temperature is high, the coarsening of austenite grains is restrained.

(C) If iron carbides are precipitated finely in the hot-rolled steel sheet or the hot-rolled and annealed steel sheet, the coarsening of austenite grains that may occur when annealing is performed at high temperatures after cold rolling is restrained. The reason for this is unclear; however, it is presumed to be attributable to the fact that (a) since iron carbides function as a nucleation site in the reverse transformation to austenite during annealing after cold rolling, as the iron carbides precipitate more finely, the nucleation frequency is raised, and the austenite grains are made fine, and (b) since the undissolved iron carbides restrain the grain growth of austenite, the austenite grains are made fine.

(D) If the final roll draft of hot rolling is increased, the coarsening of austenite grains that may occur when annealing is performed at high temperatures after cold rolling is restrained. The reason for this is unclear; however, it is presumed to be attributable to the fact that (a) with the increase in final roll draft, the bcc grains in the hot-rolled steel sheet or the hot-rolled and annealed steel sheet is made fine, and (b) with the increase in final roll draft, the iron carbides are made fine, and the number density thereof increases.

(E) In the coiling process after immediate rapid cooling, if the coiling temperature is raised to a temperature exceeding 400° C., the coarsening of austenite grains that may occur when annealing is performed at high temperatures after cold rolling is restrained. The reason for this is unclear; however, it is presumed to be attributable to the fact that since the grains of hot-rolled steel sheet are made fine by immediate rapid cooling, with the rise in coiling temperature, the precipitation amount of iron carbides in the hot-rolled steel sheet increases remarkably.

(F) Even if the hot-rolled steel sheet produced with the coiling temperature being made a low temperature of lower than 400° C. in the coiling process after immediate rapid cooling is subjected to hot-rolled sheet annealing in which the hot-rolled steel sheet is heated to the temperature region of 300° C. or higher, the coarsening of austenite grains that may occur when annealing is performed at high temperatures after cold rolling is restrained. The reason for this is unclear; however, it is presumed to be attributable to the fact that since the low-temperature transformation producing phase in the metallic structure of hot-rolled steel sheet is made fine by immediate rapid cooling, if the hot-rolled steel sheet is annealed, iron carbides precipitate finely within the low-temperature transformation producing phase.

(G) As the Si content in the steel increases, the effect of preventing the coarsening of austenite grains becomes stronger. The reason for this is unclear; however, it is presumed to be attributable to the fact that with the increase in Si content, the iron carbides are made fine, and the number density thereof increases.

(H) If the steel sheet is soaked at a high temperature while the coarsening of austenite grains is restrained and is cooled, a metallic structure is obtained in which the main phase is a fine low-temperature transformation producing phase, the secondary phase contains fine retained austenite, and coarse austenite grains are few.

FIG. 1 is a graph showing the result of investigation of grain size distribution of retained austenite in an annealed steel sheet obtained by hot-rolling under the conditions of the final roll draft of 42% in thickness decrease percentage, the rolling finishing temperature of 900° C., the rapid cooling stop temperature of 660° C., and the immediate rapid cooling process of 0.16 seconds from rolling completion to rapid cooling stop, and cold rolling with the coiling temperature of 520° C., followed by annealing at a soaking temperature of 850° C. FIG. 2 is a graph showing the result of investigation of grain size distribution of retained austenite in an annealed steel sheet obtained by hot-rolling a slab having the same chemical composition by using an ordinary method without the immediate rapid cooling process, and by cold rolling and annealing the hot-rolled steel sheet. From the comparison of FIG. 1 and FIG. 2, it can be seen that, for the annealed steel sheet produced through a proper immediate rapid cooling process (FIG. 1), the formation of coarse austenite grains is restrained, and retained austenite is dispersed finely.

(I) The cold-rolled steel sheet having such a metallic structure exhibits not only high strength but also excellent ductility, work hardening property, and stretch flanging property.

From the above-described results, it was revealed that a hot-rolled steel sheet or a hot-rolled and annealed steel sheet having a fine metallic structure, which is obtained by hot-rolling a steel containing a certain amount or more of Si with the final draft being increased, thereafter by subjecting the hot-rolled steel sheet to immediate rapid cooling, by either coiling the steel sheet at a high temperature or coiling the steel sheet at a low temperature and then by subjecting the steel sheet to hot-rolled sheet annealing, is cold-rolled, and the obtained cold-rolled steel sheet is annealed at a high temperature, and thereafter is cooled, whereby a cold-rolled steel sheet excellent in ductility, work hardening property, and stretch flanging property, which has a metallic structure such that the main phase is a low-temperature transformation producing phase, the secondary phase contains fine retained austenite, and coarse austenite grains are few, can be produced.

In one aspect, the present invention provides a method for producing a cold-rolled steel sheet having a metallic structure such that the main phase is a low-temperature transformation producing phase, and the secondary phase contains retained austenite, characterized in that the method has the following processes (A) and (B) (first invention):

(A) a cold-rolling step in which a hot-rolled steel sheet having a chemical composition consisting, in mass percent, of C: more than 0.020% and less than 0.30%, Si: more than 0.10% and at most 3.00%, Mn: more than 1.00% and at most 3.50%, P: at most 0.10%, S: at most 0.010%, sol.Al: at least 0% and at most 2.00%, N: at most 0.010%, Ti: at least 0% and less than 0.050%, Nb: at least 0% and less than 0.050%, V: at least 0% and at most 0.50%, Cr: at least 0% and at most 1.0%, Mo: at least 0% and at most 0.50%, B: at least 0% and at most 0.010%, Ca: at least 0% and at most 0.010%, Mg: at least 0% and at most 0.010%, REM: at least 0% and at most 0.050%, and Bi: at least 0% and at most 0.050%, the remainder of Fe and impurities, wherein the average grain size of the grains having a bcc structure and the grains having a bct structure surrounded by a grain boundary having an orientation difference of 15° or larger is 6.0 μm or smaller, is subjected to cold rolling to form a cold-rolled steel sheet; and (B) an annealing process in which the cold-rolled steel sheet is subjected to soaking treatment in the temperature region of ($Ac_3$ point−40° C.) or higher, thereafter cooled to the temperature region of 500° C. or lower and 300° C. or higher, and is held in that temperature region for 30 seconds or longer.

The hot-rolled steel sheet is preferably a steel sheet in which the average number density of iron carbides existing in the metallic structure is $1.0\times10^{-1}/\mu m^2$ or higher.

In another aspect, the present invention provides a method for producing a cold-rolled steel sheet having a metallic structure such that the main phase is a low-temperature transformation producing phase, and the secondary phase contains retained austenite, characterized in that the method has the following processes (C) to (E) (second invention):

(C) a hot-rolling process in which a slab having the above-described chemical composition is subjected to hot rolling such that the roll draft of the final one pass is higher than 15%, and rolling is finished in the temperature region of $Ar_3$ point or higher to form a hot-rolled steel sheet, and the hot-rolled steel sheet is cooled to the temperature region of 780° C. or lower within 0.4 seconds after the completion of the rolling, and is coiled in the temperature region of higher than 400° C.;

(D) a cold-rolling process in which the hot-rolled steel sheet obtained by the above-described process (C) is subjected to cold rolling to form a cold-rolled steel sheet; and (E) an annealing process in which the cold-rolled steel sheet is subjected to soaking treatment in the temperature region of ($Ac_3$ point−40° C.) or higher, thereafter cooled to the temperature region of 500° C. or lower and 300° C. or higher, and is held in that temperature region for 30 seconds or longer.

In still another aspect, the present invention provides a method for producing a cold-rolled steel sheet having a metallic structure such that the main phase is a low-temperature transformation producing phase, and the secondary phase contains retained austenite, characterized in that the method has the following processes (F) to (I) (third invention):

(F) a hot-rolling process in which a slab having the above-described chemical composition is subjected to hot rolling such that the rolling is finished in the temperature region of $Ar_3$ point or higher to form a hot-rolled steel sheet, and the hot-rolled steel sheet is cooled to the temperature region of 780° C. or lower within 0.4 seconds after the completion of the rolling, and is coiled in the temperature region of lower than 400° C.;

(G) a hot-rolled sheet annealing process in which the hot-rolled steel sheet obtained by the process (F) is subjected to annealing such that the hot-rolled steel sheet is heated to the temperature region of 300° C. or higher to form a hot-rolled and annealed steel sheet;

(H) a cold-rolling process in which the hot-rolled and annealed steel sheet is subjected to cold rolling to form a cold-rolled steel sheet; and (I) an annealing process in which the cold-rolled steel sheet is subjected to soaking treatment in the temperature region of ($Ac_3$ point−40° C.) or higher, thereafter cooled to the temperature region of 500° C. or lower and 300° C. or higher, and is held in that temperature region for 30 seconds or longer.

In the metallic structure of the cold-rolled steel sheet, the secondary phase preferably contains retained austenite and polygonal ferrite.

In the cold-rolling process (A), (D) or (H), the cold rolling is preferably performed at a total draft exceeding 50%.

In the annealing process (B), (E) or (I), preferably, the soaking treatment is performed in the temperature region of ($Ac_3$ point−40° C.) or higher and lower than ($Ac_3$ point+50° C.), and/or the cooling is performed by 50° C. or more at a cooling rate of lower than 10.0° C./s after the soaking treatment.

In the preferred mode, the chemical composition further contains at least one kind of the elements (% means mass percent) described below.

One kind or two or more kinds selected from a group consisting of Ti: at least 0.005% and less than 0.050%, Nb: at least 0.005% and less than 0.050%, and V: at least 0.010% and at most 0.50%; and/or One kind or two or more kinds selected from a group consisting of Cr: at least 0.20% and at most 1.0%, Mo: at least 0.05% and at most 0.50%, and B: at least 0.0010% and at most 0.010%; and/or One kind or two or more kinds selected from a group consisting of Ca: at least 0.0005% and at most 0.010%, Mg: at least 0.0005% and at most 0.010%, REM: at least 0.0005% and at most 0.050%, and Bi: at least 0.0010% and at most 0.050%.

According to the present invention, a high-tensile cold-rolled steel sheet having sufficient ductility, work hardening property, and stretch flanging property, which can be used for working such as press forming, can be produced. Therefore, the present invention can greatly contribute to the development of industry. For example, the present invention can contribute to the solution to global environment problems through the lightweight of automotive vehicle body.

DESCRIPTION OF EMBODIMENTS

Figure 1:
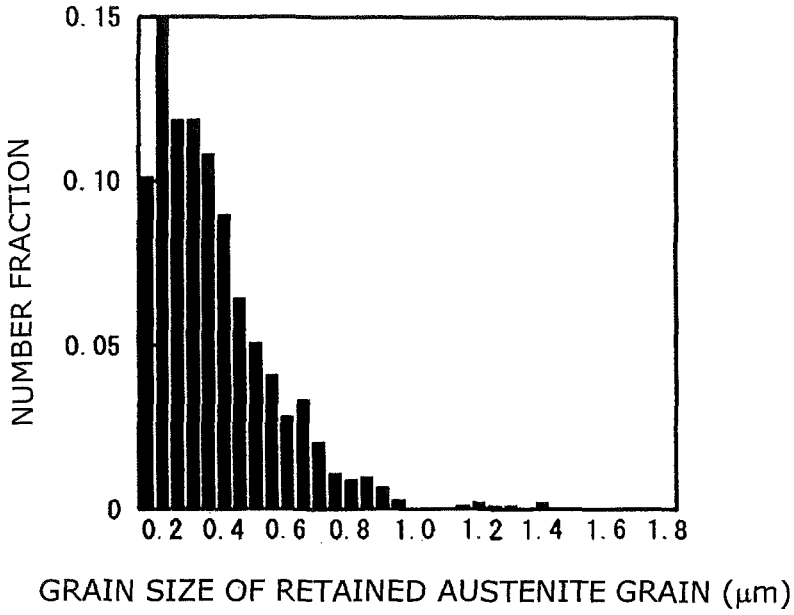
FIG. 1 is a graph showing grain size distribution of retained austenite in an annealed steel sheet produced through an immediate rapid cooling process.
Figure 2:
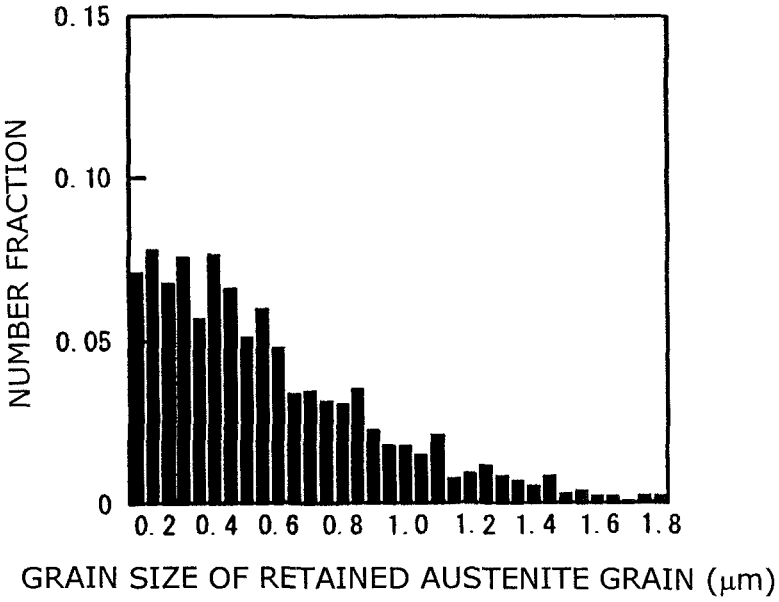
FIG. 2 is a graph showing grain size distribution of retained austenite in an annealed steel sheet produced without an immediate rapid cooling process.

The metallic structure and chemical composition in a high-tensile cold-rolled steel sheet produced by the method in accordance with the present invention, and the rolling and annealing conditions and the like in the method in accordance with the present invention capable of producing the steel sheet efficiently, steadily, and economically are described in detail below.

1. Metallic Structure

The cold-rolled steel sheet of the present invention has a metallic structure such that the main phase is a low-temperature transformation producing phase, and the secondary phase contains retained austenite. This is because such a metallic structure is preferable for improving the ductility, work hardening property, and stretch flanging property while the tensile strength is kept. If the main phase is polygonal ferrite that is not a low-temperature transformation producing phase, it is difficult to assure the tensile strength and stretch flanging property.

The main phase means a phase or structure in which the volume ratio is at the maximum, and the secondary phase means a phase or structure other than the main phase. The low-temperature transformation producing phase means a phase and structure formed by low-temperature transformation, such as martensite and bainite. As a low-temperature transformation producing phase other than these, bainitic ferrite and tempered martensite are cited. The bainitic ferrite is distinguished from polygonal ferrite in that a lath shape or a plate shape is taken and that the dislocation density is high, and is distinguished from bainite in that iron carbides do not exist in the interior and at the interface. This low-temperature transformation producing phase may contain two or more kinds of phases and structures, for example, martensite and bainitic ferrite. In the case where the low-temperature transformation producing phase contains two or more kinds of phases and structures, the sum of volume ratios of these phases and structures is defined as the volume ratio of the low-temperature transformation producing phase.

To improve the ductility, the volume ratio of retained austenite to total structure preferably exceeds 4.0%. This volume ratio further preferably exceeds 6.0%, still further preferably exceeds 9.0%, and most preferably exceeds 12.0%. On the other hand, if the volume ratio of retained austenite is excessive, the stretch flanging property deteriorates. Therefore, the volume ratio of retained austenite is preferably lower than 25.0%, further preferably lower than 18.0%, still further preferably lower than 16.0%, and most preferably lower than 14.0%.

In the cold-rolled steel sheet having a metallic structure such that the main phase is a low-temperature transformation producing phase, and the secondary phase contains retained austenite, if the grains of retained austenite are made fine, the ductility, work hardening property, and stretch flanging property are improved remarkably. Therefore, the average grain size of retained austenite is preferably made smaller than 0.80 μm. This average grain size is further preferably made smaller than 0.70 μm, still further preferably made smaller than 0.60 μm. The lower limit of the average grain size of retained austenite is not subject to any special restriction; however, in order to make the average grain size 0.15 μm or smaller, it is necessary to greatly increase the final roll draft of hot rolling, which leads to a remarkably increased production load. Therefore, the lower limit of the average grain size of retained austenite is preferably made larger than 0.15 μm.

In the cold-rolled steel sheet having a metallic structure such that the main phase is a low-temperature transformation producing phase, and the secondary phase contains retained austenite, even if the average grain size of retained austenite is small, if coarse retained austenite grains exist in large amounts, the work hardening property and stretch flanging property are liable to be impaired. Therefore, the number density of retained austenite grains each having a grain size of 1.2 μm or larger is preferably made $3.0\times10^{-2}/\mu m^2$ or lower. This number density is further preferably $2.0\times10^{-2}/\mu m^2$ or lower, still further preferably $1.5\times10^{-2}/\mu m^2$ or lower, and most preferably $1.0\times10^{-2}/\mu m^2$ or lower.

To further improve the ductility and work hardening property, the secondary phase preferably contains polygonal ferrite in addition to retained austenite. The volume ratio of polygonal ferrite to total structure preferably exceeds 2.0%. This volume ratio further preferably exceeds 8.0%, still further preferably exceeds 13.0%. On the other hand, if the volume ratio of polygonal ferrite is excessive, the stretch flanging property deteriorates. Therefore, the volume ratio of polygonal ferrite is preferably lower than 27.0%, further preferably lower than 24.0%, and still further preferably lower than 18.0%.

As the grains of polygonal ferrite are finer, the effect of improving the ductility and work hardening property increases. Therefore, the average crystal grain size of polygonal ferrite is preferably made smaller than 5.0 μm. This average crystal grain size is further preferably smaller than 4.0 μm, still further preferably smaller than 3.0 μm.

To further improve the stretch flanging property, the volume ratio of tempered martensite contained in the low-temperature transformation producing phase to total structure is preferably made lower than 50.0%. This volume ratio is further preferably lower than 35.0%, still further preferably lower than 10.0%.

To enhance the tensile strength, the low-temperature transformation producing phase preferably contain martensite. In this case, the volume ratio of martensite to total structure preferably exceeds 4.0%. This volume ratio further preferably exceeds 6.0%, still further preferably exceeds 10.0%. On the other hand, if the volume ratio of martensite is excessive, the stretch flanging property deteriorates. Therefore, the volume ratio of martensite to total structure is preferably made lower than 15.0%.

The metallic structure of the cold-rolled steel sheet in accordance with the present invention is measured as described below. The volume ratios of low-temperature transformation producing phase and polygonal ferrite are determined. Specifically, a test specimen is sampled from the steel sheet, and the longitudinal cross sectional surface thereof parallel to the rolling direction is polished, and is corroded with nital. Thereafter, the metallic structure is observed by using a SEM at a position deep by one-fourth of thickness from the surface of steel sheet. By image processing, the area fractions of low-temperature transformation producing phase and polygonal ferrite are measured. Assuming that the area fraction is equal to the volume ratio, the volume ratios of low-temperature transformation producing phase and polygonal ferrite are determined. The average grain size of polygonal ferrite is determined as described below. A circle corresponding diameter is determined by dividing the area occupied by the whole of polygonal ferrite in a visual field by the number of crystal grains of polygonal ferrite, and the circle corresponding diameter is defined as the average grain size.

The volume ratio of retained austenite is determined as described below. A test specimen is sampled from the steel sheet, and the rolled surface thereof is chemically polished to a position deep by one-fourth of thickness from the surface of steel sheet, and the X-ray diffraction intensity is measured by using an XRD apparatus.

The grain size of retained austenite and the average grain size of retained austenite are measured as described below. A test specimen is sampled from the steel sheet, and the longitudinal cross sectional surface thereof parallel to the rolling direction is electropolished. The metallic structure is observed at a position deep by one-fourth of thickness from the surface of steel sheet by using a SEM equipped with an EBSP analyzer. A region that is observed as a phase consisting of a face-centered cubic crystal structure (fcc phase) and is surrounded by the parent phase is defined as one retained austenite grain. By image processing, the number density (number of grains per unit area) of retained austenite grains and the area fractions of individual retained austenite grains are measured. From the areas occupied by individual retained austenite grains in a visual field, the circle corresponding diameters of individual retained austenite grains are determined, and the mean value thereof is defined as the average grain size of retained austenite.

In the structure observation using the EBSP, in the region of 50 μm or larger in the sheet thickness direction and 100 μm or larger in the rolling direction, electron beams are applied at a pitch of 0.1 μm to make judgment of phase. Also, among the obtained measured data, the data in which the reliability index is 0.1 or more are used for grain size measurement as effective data. Also, to prevent the grain size of retained austenite from being undervalued by measurement noise, only the retained austenite grains each having a circle corresponding diameter of 0.15 μm or larger is taken as effective grains, whereby the average grain size of retained austenite is calculated.

In the present invention, the above-described metallic structure is defined at a position deep by one-fourth of thickness from the surface of steel sheet in the case of cold-rolled steel sheet, and at a position deep by one-fourth of thickness of steel sheet, which is a base material, from the boundary between the base material steel sheet and a plating layer in the case of plated steel sheet.

As the mechanical property that can be realized based on the feature of the above-described metallic structure, to assure the shock absorbing property, the steel sheet of the present invention preferably has a tensile strength (TS) of 780 MPa or higher, further preferably has that of 950 MPa or higher, in the direction perpendicular to the rolling direction. Also, to assure the ductility, the TS is preferably lower than 1180 MPa.

When the value obtained by converting the total elongation ($El_0$) in the direction perpendicular to the rolling direction into a total elongation corresponding to the sheet thickness of 1.2 mm based on formula (1) below is taken as El, the work hardening index calculated by using the nominal strains of two points of 5% and 10% with the strain range being made 5 to 10% in conformity to Japanese Industrial Standards JIS Z2253 and the test forces corresponding to these strains is taken as n value, and the bore expanding ratio measured in conformity to Japan Iron and Steel Federation Standards JFST1001 is taken as λ, from the viewpoint of press formability, it is preferable that the value of TS×El be 15,000 MPa % or higher, the value of TS×n value be 150 MPa or higher, and the value of $TS^{1.7}\times\lambda$ be 4,500,000 $MPa^{1.7}$% or higher.

$$El=El_0\times(1.2/t_0)^{0.2} \quad (1)$$

in which $El_0$ is the actually measured value of total elongation measured by using JIS No. 5 tensile test specimen, to is the thickness of JIS No. 5 tensile test specimen used for measurement, and El is the converted value of total elongation corresponding to the case where the sheet thickness is 1.2 mm.

TS×El is an index for evaluating the ductility from the balance between strength and total elongation, TS×n value is an index for evaluating the work hardening property from the balance between strength and work hardening index, and $TS^{1.7}\times\lambda$ is an index for evaluating the bore expandability from the balance between strength and bore expanding ratio.

It is further preferable that the value of TS×El be 19,000 MPa % or higher, the value of TS×n value be 160 MPa or higher, and the value of $TS^{1.7}\times\lambda$ be 5,500,000 $MPa^{1.7}$% or higher. It is still further preferable that the value of TS×El be 20,000 MPa % or higher, the value of TS×n value be 165 MPa or higher, and the value of $TS^{1.7}\times\lambda$ be 6,000,000 $MPa^{1.7}$% or higher.

Since the strain occurring when an automotive part is press-formed is about 5 to 10%, the work hardening index was expressed by n value for the strain range of 5 to 10% in the tension test. Even if the total elongation of steel sheet is large, the strain propagating property in the press forming of automotive part is insufficient when the n value is low, and defective forming such as a local thickness decrease occurs easily. Also, from the viewpoint of shape fixability, the yield ratio is preferably lower than 80%, further preferably lower than 75%, and still further preferably lower than 70%.

2. Chemical Composition of Steel

C: more than 0.020% and less than 0.30%

If the C content is 0.020% or less, it is difficult to obtain the above-described metallic structure. Therefore, the C content is made more than 0.020%. The C content is preferably more than 0.070%, further preferably more than 0.10%, and still further preferably more than 0.14%. On the other hand, if the C content is 0.30% or more, not only the stretch flanging property of steel sheet is impaired, but also the weldability is deteriorated. Therefore, the C content is made less than 0.30%. The C content is preferably less than 0.25%, further preferably less than 0.20%, and still further preferably less than 0.17%.

Si: more than 0.10% and 3.00% or less

Silicon (Si) has a function of improving the ductility, work hardening property, and stretch flanging property through the restraint of austenite grain growth during annealing. Also, Si is an element that has a function of enhancing the stability of austenite and is effective in obtaining the above-described metallic structure. If the Si content is 0.10% or less, it is difficult to achieve the effect brought about by the above-described function. Therefore, the Si content is made more than 0.10%. The Si content is preferably more than 0.60%, further preferably more than 0.90%, and still further preferably more than 1.20%. On the other hand, if the Si content is more than 3.00%, the surface properties of steel sheet are deteriorated. Further, the chemical conversion treatability and the platability are deteriorated remarkably. Therefore, the Si content is made 3.00% or less. The Si content is preferably less than 2.00%, further preferably less than 1.80%, and still further preferably less than 1.60%.

In the case where the later-described Al is contained, the Si content and the sol.Al content preferably satisfy formula (2) below, further preferably satisfy formula (3) below, and still further preferably satisfy formula (4) below.

$$Si+sol.Al>0.60 \quad (2)$$

$$Si+sol.Al>0.90 \quad (3)$$

$$Si+sol.Al>1.20 \quad (4)$$

in which, Si represents the Si content (mass %) in the steel, and sol.Al represents the content (mass %) of acid-soluble Al.

Mn: more than 1.00% and 3.50% or less

Manganese (Mn) is an element that has a function of improving the hardenability of steel and is effective in obtaining the above-described metallic structure. If the Mn content is 1.00% or less, it is difficult to obtain the above-described metallic structure. Therefore, the Mn content is made more than 1.00%. The Mn content is preferably more than 1.50%, further preferably more than 1.80%, and still further preferably more than 2.10%. If the Mn content becomes too high, in the metallic structure of hot-rolled steel sheet, a coarse low-temperature transformation producing phase elongating and expanding in the rolling direction is formed, coarse retained austenite grains increase in the metallic structure after cold rolling and annealing, and the work hardening property and stretch flanging property are deteriorated. Therefore, the Mn content is made 3.50% or less. The Mn content is preferably less than 3.00%, further preferably less than 2.80%, and still further preferably less than 2.60%.

P: 0.10% or less

Phosphorus (P) is an element contained in the steel as an impurity, and segregates at the grain boundaries and embrittles the steel. For this reason, the P content is preferably as low as possible. Therefore, the P content is made 0.10% or less. The P content is preferably less than 0.050%, further preferably less than 0.020%, and still further preferably less than 0.015%.

S: 0.010% or less

Sulfur (S) is an element contained in the steel as an impurity, and forms sulfide-base inclusions and deteriorates the stretch flanging property. For this reason, the S content is preferably as low as possible. Therefore, the S content is made 0.010% or less. The S content is preferably less than 0.005%, further preferably less than 0.003%, and still further preferably less than 0.002%.

sol.Al: 2.00% or less

Aluminum (Al) has a function of deoxidizing molten steel. In the present invention, since Si having a deoxidizing function like Al is contained, Al need not necessarily be contained. That is, the sol.Al content may be close to 0% unlimitedly. In the case where sol.Al is contained for the purpose of promotion of deoxidation, 0.0050% or more of sol.Al is preferably contained. The sol.Al content is further preferably more than 0.020%. Also, like Si, Al is an element that has a function of enhancing the stability of austenite and is effective in obtaining the above-described metallic structure. Therefore, Al can be contained for this purpose. In this case, the sol.Al content is preferably more than 0.040%, further preferably more than 0.050%, and still further preferably more than 0.060%. On the other hand, if the sol.Al content is too high, not only a surface flaw caused by alumina is liable to occur, but also the transformation point rises greatly, so that it is difficult to obtain a metallic structure such that the main phase is a low-temperature transformation producing phase. Therefore, the sol.Al content is made 2.00% or less. The sol.Al content is preferably less than 0.60%, further preferably less than 0.20%, and still further preferably less than 0.10%.

N: 0.010% or less

Nitrogen (N) is an element contained in the steel as an impurity, and deteriorates the ductility. For this reason, the N content is preferably as low as possible. Therefore, the N content is made 0.010% or less. The N content is preferably 0.006% or less, further preferably 0.005% or less.

The steel sheet produced by the method in accordance with the present invention may contain elements described below as optional elements.

One kind or two or more kinds selected from a group consisting of Ti: less than 0.050%, Nb: less than 0.050%, and V: 0.50% or less Ti, Nb and V each have a function of increasing the work strain by means of the restraint of recrystallization in the hot-rolling process, and have a function of making the metallic structure of hot-rolled steel sheet fine. Also, these elements precipitate as carbides or nitrides, and have a function of restraining the coarsening of austenite during annealing. Therefore, one kind or two or more kinds of these elements may be contained. However, even if these elements are contained excessively, the effect brought about by the above-described function saturates, being uneconomical. Rather, the recrystallization temperature at the time of annealing rises, the metallic structure after annealing becomes uneven, and the stretch flanging property is also impaired. Furthermore, the precipitation amount of carbides or nitrides increases, the yield ratio ascends, and the shape fixability also deteriorates. Therefore, the Ti content is made less than 0.050%, the Nb content is made less than 0.050%, and the V content is made 0.50% or less. The Ti content is preferably less than 0.040%, further preferably less than 0.030%. The Nb content is preferably less than 0.040%, further preferably less than 0.030%. The V content is preferably 0.30% or less, further preferably less than 0.050%. To surely achieve the effect brought about by the above-described function, either of Ti: 0.005% or more, Nb: 0.005% or more, and V: 0.010% or more is preferably satisfied. In the case where Ti is contained, the Ti content is further preferably made 0.010% or more, in the case where Nb is contained, the Nb content is further preferably made 0.010% or more, and in the case where V is contained, the V content is further preferably made 0.020% or more.

One kind or two or more kinds selected from a group consisting of Cr: 1.0% or less, Mo: 0.50% or less, and B: 0.010% or less Cr, Mo and B are elements that have a function of improving the hardenability of steel and are effective in obtaining the above-described metallic structure. Therefore, one kind or two or more kinds of these elements may be contained. However, even if these elements are contained excessively, the effect brought about by the above-described function saturates, being uneconomical. Therefore, the Cr content is made 1.0% or less, the Mo content is made 0.50% or less, and the B content is made 0.010% or less. The Cr content is preferably 0.50% or less, the Mo content is preferably 0.20% or less, and the B content is preferably 0.0030% or less. To more surely achieve the effect brought about by the above-described function, either of Cr: 0.20% or more, Mo: 0.05% or more, and B: 0.0010% or more is preferably satisfied.

One kind or two or more kinds selected from a group consisting of Ca: 0.010% or less, Mg: 0.010% or less, REM: 0.050% or less, and Bi: 0.050% or less Ca, Mg and REM each have a function of improve the stretch flanging property by means of the regulation of shapes of inclusions, and Bi also has a function of improve the stretch flanging property by means of the refinement of solidified structure. Therefore, one kind or two or more kinds of these elements may be contained. However, even if these elements are contained excessively, the effect brought about by the above-described function saturates, being uneconomical. Therefore, the Ca content is made 0.010% or less, the Mg content is made 0.010% or less, the REM content is made 0.050% or less, and the Bi content is made 0.050% or less. Preferably, the Ca content is 0.0020% or less, the Mg content is 0.0020% or less, the REM content is 0.0020% or less, and the Bi content is 0.010% or less. To more surely obtain above-described function, either of Ca: 0.0005% or more, Mg: 0.0005% or more, REM: 0.0005% or more, and Bi: 0.0010% or more is preferably satisfied. The REM means rare earth metals, and is a general term of a total of 17 elements of Sc, Y, and lanthanoids. The REM content is the total content of these elements.

3. Production Conditions (Cold-Rolling Process in First Invention)

In the cold-rolling process, a hot-rolled steel sheet having the above-described chemical composition, in which the average grain size of grains having a bcc structure and the grains having a bct structure (as described already, these grains are generally called "bcc grains") surrounded by a grain boundary having an orientation difference of 15° or larger is 6.0 μm or smaller, and preferably, furthermore, the average number density of iron carbides existing in the metallic structure is $1.0\times10^{-1}/\mu m^2$ or higher, is cold-rolled to form a cold-rolled steel sheet.

Herein, the average grain size of bcc grains is calculated by the method described below. A test specimen is sampled from the steel sheet, the longitudinal cross sectional surface thereof parallel to the rolling direction is electropolished, and the metallic structure is observed by using a SEM equipped with an EBSP analyzer at a position deep by one-fourth of thickness from the surface of steel sheet. A region that is observed as the phase consisting of a body-centered cubic crystal type crystal structure and is surrounded by a boundary having an orientation difference of 15° or larger is taken as one crystal grain, and the value calculated by formula (5) below is taken as the average grain size of bcc grains. In this formula, N is the number of crystal grains contained in the average grain size evaluation region, Ai is the area of the i-th (i=1, 2, . . . , N) crystal grain, and di is the circle corresponding diameter of i-th crystal grain.

[Expression 1]

$$D = \frac{\sum_{i=1}^{N} A_i \times d_i}{\sum_{i=1}^{N} A_i} \quad (5)$$

The crystal structure of martensite is strictly a body-centered tetragonal lattice (bet); however, in the grain size evaluation of the present invention, martensite is also handled as the bcc phase because in the metallic structure evaluation using the EBSP, the lattice constant is not considered.

In the structure evaluation by using the EBSP in this embodiment, the phase of a region having a size of 50 μm in the sheet thickness direction and of 100 μm in the rolling direction (the direction perpendicular to the sheet thickness direction) is judged by controlling the electron beams at a pitch of 0.1 μm. Among the obtained measured data, the data in which the reliability index is 0.1 or more is used for grain size measurement as effective data. Further, to prevent the grain size from being undervalued by measurement noise, in the evaluation of bcc grains, unlike the before-described case of retained austenite, the above-described grain size calculation is performed by taking only the bcc grains each having a grain size of 0.47 μm or larger as effective grains.

The reason why the crystal grain size is defined by taking the grain boundary having an orientation difference of 15° or larger as an effective grain boundary is that the grain boundary having an orientation difference of 15° or larger becomes an effective nucleation site of reverse transformation austenite grains, whereby the coarsening of austenite grains at the time of annealing after cold rolling is restrained, and the nucleation site contributes greatly to the improvement in workability of cold-rolled steel sheet. Also, in the case where the structure of hot-rolled steel sheet is a mixed grain size structure in which fine grains and coarse grains are intermixing, the portion of coarse grains easily coarsens at the time of annealing after cold rolling, so that the ductility, work hardening property, and stretch flanging property are deteriorated. In the case where the grain size of such a mixed grain size structure is evaluated by the cutting method used generally as the evaluation of crystal grain size of metallic structure, the influence of coarse grains may be undervalued. In the present invention, as a calculation method of crystal grain size considering the influence of coarse grains, the above-described formula (5), in which the individual areas of crystal grains are multiplied as a weight, is used.

The amount of iron carbides existing in the steel sheet is defined by the average number density (unit: number/$\mu m^2$), and the average number density of the iron carbides is measured as described below. A test specimen is sampled from the steel sheet, the longitudinal cross sectional surface thereof parallel to the rolling direction is polished, and the metallic structure is observed by using an optical microscope or a SEM at a position deep by one-fourth of thickness from the surface of steel sheet. The composition analysis of precipitates is made by using an Auger electron spectroscope (AES), the precipitates containing Fe and C as constituent elements are taken as iron carbides, and the number density of iron carbides in the metallic structure is measured. In the number density evaluation of iron carbides of the present invention, observation was accomplished in five visual fields of $10^2$ $\mu m^2$ at a magnification of ×5000, the number of iron carbides existing in the metallic structure in each visual field was measured, and the average number density was calculated from the mean value of the five visual fields. The iron carbides means compounds consisting mainly of Fe and C, and $Fe_3C$, $Fe_3(C, B)$, $Fe_{23}(C, B)_6$, $Fe_2C$, $Fe_{2.2}C$, $Fe_{2.4}C$, and the like are cited as iron carbides. In order to efficiently restrain the coarsening of austenite, the iron carbide is preferably $Fe_3C$. Also, a steel component such as Mn and Cr may be dissolved in these iron carbides.

For the hot-rolled steel sheet to be subjected to cold rolling, in the case where the average grain size of bcc grains calculated by the above-described method exceeds 6.0 μm, the metallic structure after cold rolling and annealing is coarsened, and the ductility, work hardening property, and stretch flanging property are impaired. Therefore, the average grain size of bcc grains is made 6.0 μm or smaller. This average grain size is preferably 4.0 μm or smaller, and further preferably 3.5 μm or smaller.

For the hot-rolled steel sheet to be subjected to cold rolling, the average number density of iron carbides existing in the metallic structure is preferably $1.0\times10^{-1}/\mu m^2$ or higher. Thereby, the coarsening of austenite in the annealing process after cold rolling is restrained, and the ductility, work hardening property, and stretch flanging property of cold-rolled steel sheet can be improved remarkably. The average number density of iron carbides is further preferably $5.0\times10^{-1}/\mu m^2$ or higher, still further preferably $8.0\times10^{-1}/\mu m^2$ or higher.

The kinds and volume ratios of the phase and structure forming the hot-rolled steel sheet are not defined especially, and one kind or two or more kinds selected from a group consisting of polygonal ferrite, acicular ferrite, bainitic ferrite, bainite, pearlite, retained austenite, martensite, tempered bainite, and tempered martensite may be intermixed. However, a softer hot-rolled steel sheet is preferable in that the load of cold rolling is alleviated and the cold rolling ratio is further increased, whereby the metallic structure after being annealed can be made fine.

The above-described method for producing a hot-rolled steel sheet is not defined especially; however, it is preferable that the hot-rolling process in the second invention, described later, or the hot-rolling process in the third invention, described later, be adopted. The above-described hot-rolled steel sheet may be a hot-rolled and annealed steel sheet subjected to annealing after being hot-rolled.

The cold rolling itself may be performed pursuant to an ordinary method. Before cold rolling, the hot rolled steel sheet may be descaled by pickling or the like means. In the cold rolling, in order to promote recrystallization and homogenize the metallic structure after cold rolling and annealing, thereby further improving the stretch flanging property, the cold rolling ratio (the total draft in cold rolling) is preferably made 40% or higher, further preferably made more than 50%. Thereby, the metallic structure after annealing is made further fine, and the aggregate structure is improved, so that the ductility, work hardening property, and stretch flanging property are further improved. From this viewpoint, the cold rolling ratio is further preferably made more than 60%, most preferably made more than 65%. On the other hand, if the cold rolling ratio is too high, the rolling load is increased, and it is difficult to perform rolling. Therefore, the upper limit of cold rolling ratio is preferably made lower than 80%, further preferably made lower than 70%.

(Annealing Process in First Invention)

The cold-rolled steel sheet obtained by the above-described cold-rolling process is annealed after being subjected to treatment such as degreasing pursuant to a publicly-known method as necessary. The lower limit of soaking temperature in annealing is made ($Ac_3$ point−40° C.) or higher. This is for the purpose of obtaining a metallic structure such that the main phase is a low-temperature transformation producing phase, and the secondary phase contains retained austenite. To increase the volume ratio of low-temperature transformation producing phase and to improve the stretch flanging property, the soaking temperature is preferably made higher than ($Ac_3$ point−20° C.), and further preferably made higher than $Ac_3$ point. However, if the soaking temperature is too high, austenite is coarsened excessively, and the formation of polygonal ferrite is restrained, so that the ductility, work hardening property, and stretch flanging property are liable to deteriorate. Therefore, the upper limit of soaking temperature is preferably made lower than ($Ac_3$ point+100° C.), further preferably made lower than ($Ac_3$ point+50° C.), and still further preferably made lower than ($Ac_3$ point+20° C.). Also, to promote the formation of fine polygonal ferrite and to improve the ductility and work hardening property, the upper limit of soaking temperature is preferably made lower than ($Ac_3$ point+50° C.), further preferably made lower than ($Ac_3$ point+20° C.).

The holding time at the soaking temperature (the soaking time) need not be subject to any special restriction; however, to attain stable mechanical properties, the holding time is preferably made longer than 15 seconds, further preferably made longer than 60 seconds. On the other hand, if the holding time is too long, austenite is coarsened excessively, so that the ductility, work hardening property, and stretch flanging property are liable to deteriorate. Therefore, the holding time is preferably made shorter than 150 seconds, further preferably made shorter than 120 seconds.

In the heating process in annealing, to homogenize the metal structure after annealing by means of the promotion of crystallization and to improve the stretch flanging property, the heating rate from 700° C. to the soaking temperature is preferably made lower than 10.0° C./s. This heating rate is further preferably made lower than 8.0° C./s, still further preferably made lower than 5.0° C./s.

In the cooling process after soaking in annealing, to promote the formation of fine polygonal ferrite and to improve the ductility and work hardening property, cooling is preferably performed by 50° C. or more from the soaking temperature at a cooling rate of lower than 10.0° C./s. This cooling rate after soaking is preferably lower than 5.0° C./s, further preferably lower than 3.0° C./s, and still further preferably lower than 2.0° C./s. To further increase the volume ratio of polygonal ferrite, cooling is performed by 80° C. or more from the soaking temperature at a cooling rate of lower than 10.0° C./s. The cooling is performed further preferably by 100° C. or more, still further preferably by 120° C. or more.

To obtain a metallic structure such that the main phase is a low-temperature transformation producing phase, the cooling in the temperature range of 650 to 500° C. is preferably performed at a cooling rate of 15° C./s or higher. To perform cooling in the temperature range of 650 to 450° C. at a cooling rate of 15° C./s or higher is further preferable. With the increase in the cooling rate, the volume ratio of the low-temperature transformation producing phase increases. Therefore, a cooling rate higher than 30° C./s is further preferable, and a cooling rate higher than 50° C./s is still further preferable. On the other hand, if the cooling rate is too high, the shape of steel sheet is deteriorated. Therefore, the cooling rate in the temperature range of 650 to 500° C. is preferably made 200° C./s or lower, further preferably made lower than 150° C./s, and still further preferably made lower than 130° C./s.

Further, to obtain retained austenite, the steel sheet is held in the temperature region of 500 to 300° C. for 30 seconds or longer. In order to enhance the stability of retained austenite and to improve the ductility, work hardening property, and stretch flanging property, the holding temperature region is preferably made 475 to 320° C. The holding temperature region is further preferably made 450 to 340° C., still further preferably made 430 to 360° C. Also, as the holding time is made longer, the stability of retained austenite increases. Therefore, the holding time is preferably made 60 seconds or longer, further preferably made 120 seconds or longer, and still further preferably made 300 seconds or longer.

In the case where an electroplated steel sheet is produced, after the cold-rolled steel sheet produced by the above-described method has been subjected to well-known preparations as necessary to purify and condition the surface, electroplating has only to be performed pursuant to an ordinary method. The chemical composition and mass of deposit of plating film is not subject to any special restriction. As the kind of electroplating, electro zinc plating, electro-Zn—Ni alloy plating, and the like are cited.

In the case where a hot dip plated steel sheet is produced, the steel sheet is treated in the above-described method up to the annealing process, and after being hold in the temperature region of 500 to 300° C. for 30 seconds or longer, the steel sheet is heated as necessary, and is immersed in a plating bath for hot dip plating. In order to enhance the stability of retained austenite and to improve the ductility, work hardening property, and stretch flanging property, the holding temperature region is preferably made 475 to 320° C. The holding temperature region is further preferably made 450 to 340° C., still further preferably made 430 to 360° C. Also, as the holding time is made longer, the stability of retained austenite increases. Therefore, the holding time is preferably made 60 seconds or longer, further preferably made 120 seconds or longer, and still further preferably made 300 seconds or longer. The steel sheet may be reheated after being hot dip plated for alloying treatment. The chemical composition and mass of deposit of plating film is not subject to any special restriction. As the kind of hot dip plating, hot dip zinc plating, alloying hot dip zinc plating, hot dip aluminum plating, hot dip Zn—Al alloy plating, hot dip Zn—Al—Mg alloy plating, hot dip Zn—Al—Mg—Si alloy plating, and the like are cited.

The plated steel sheet may be subjected to suitable chemical conversion treatment after being plated to further enhance the corrosion resistance. In place of the conventional chromate treatment, the chemical conversion treatment is preferably performed by using a non-chrome type chemical conversion liquid (for example, silicate-based or phosphate-based).

The cold-rolled steel sheet and plated steel sheet thus obtained may be subjected to temper rolling pursuant to an ordinary method. However, a large elongation percentage of temper rolling leads to the deterioration in ductility. Therefore, the elongation percentage of temper rolling is preferably made 1.0% or smaller, further preferably made 0.5% or smaller (Hot-Rolling Process in Second Invention)

A steel having the above-described chemical composition is melted by publicly-known means and thereafter is formed into an ingot by the continuous casting process, or is formed into an ingot by an optional casting process and thereafter is formed into a billet by a billeting process or the like. In the continuous casting process, to suppress the occurrence of a surface defect caused by inclusions, an external additional flow such as electromagnetic stirring is preferably produced in the molten steel in the mold. Concerning the ingot or billet, the ingot or billet that has been cooled once may be reheated and be subjected to hot rolling. Alternatively, the ingot that is in a high-temperature state after continuous casting or the billet that is in a high-temperature state after billeting may be subjected to hot rolling as it is, or by retaining heat, or by heating it auxiliarily. In this description, such an ingot and a billet are generally called a "slab" as a raw material for hot rolling. To prevent austenite from coarsening, the temperature of the slab that is to be subjected to hot rolling is preferably made lower than 1250° C., further preferably made lower than 1200° C. The lower limit of the temperature of slab to be subjected to hot rolling need not be restricted specially, and may be any temperature at which hot rolling can be finished at $Ar_3$ point or higher as described later.

The hot rolling is finished in the temperature region of $Ar_3$ point or higher to make the metallic structure of hot-rolled steel sheet fine by means of transformation of austenite after the completion of rolling. If the temperature of rolling completion is too low, in the metallic structure of hot-rolled steel sheet, a coarse low-temperature transformation producing phase elongating and expanding in the rolling direction is formed, the metallic structure after cold rolling and annealing is coarsened, and the ductility, work hardening property, and stretch flanging property is liable to be deteriorated. Therefore, the finishing temperature of hot rolling is preferably made $Ar_3$ point or higher and higher than 820° C., further preferably made $Ar_3$ point or higher and higher than 850° C., and still further preferably made $Ar_3$ point or higher and higher than 880° C. On the other hand, if the hot rolling finishing temperature is too high, the accumulation of work strain is insufficient, and it is difficult to make the metallic structure of hot-rolled steel sheet fine. Therefore, the hot rolling finishing temperature is preferably lower than 950° C., further preferably lower than 920° C. Also, to lighten the production load, it is preferable that the finishing temperature of hot rolling be raised and thereby the rolling load be reduced. From this viewpoint, the finishing temperature of hot rolling is preferably made $Ar_3$ point or higher and higher than 780° C., further preferably made $Ar_3$ point or higher and higher than 800° C.

In the case where the hot rolling consists of rough rolling and finish rolling, to finish the finish rolling at the above-described temperature, the rough-rolled material may be heated at the time between rough rolling and finish rolling. It is desirable that by heating the rough-rolled material so that the temperature of the rear end thereof is higher than that of the front end thereof, the fluctuations in temperature throughout the overall length of the rough-rolled material at the start time of finish rolling are restrained to 140° C. or less. Thereby, the homogeneity of product properties in a coil is improved.

The heating method of the rough-rolled material has only to be carried out by using publicly-known means. For example, a solenoid type induction heating apparatus is provided between a roughing mill and a finish rolling mill, and the temperature rising amount in heating may be controlled based on, for example, the temperature distribution in the lengthwise direction of the rough-rolled material on the upstream side of the induction heating apparatus.

Concerning the roll draft of hot rolling, the roll draft of the final one pass is made higher than 15% in thickness decrease percentage. The reason for this is that the work strain amount introduced to austenite is increased, the metallic structure of hot-rolled steel sheet is made fine, the metallic structure after cold rolling and annealing is made fine, and the ductility, work hardening property, and stretch flanging property are improved. The roll draft of the final one pass is preferably made higher than 25%, further preferably made more than 30%, and still further preferably made more than 40%. If the roll draft is too high, the rolling load increases, and it is difficult to perform rolling. Therefore, the roll draft of the final one pass is preferably made lower than 55%, further preferably made lower than 50%. To reduce the rolling load, so-called lubrication rolling may be performed in which rolling is performed while a rolling oil is supplied between a rolling roll and a steel sheet to decrease the friction coefficient.

After hot rolling, the steel sheet is cooled rapidly to the temperature region of 780° C. or lower within 0.40 seconds after the completion of rolling. The reason for this is that the release of work strain introduced to austenite by rolling is restrained, austenite is transformed with the work strain being used as a driving force, the metallic structure of hot-rolled steel sheet is made fine, the metallic structure after cold rolling and annealing is made fine, and the ductility, work hardening property, and stretch flanging property are improved. As the time up to the stop of rapid cooling is shorter, the release of work strain is restrained. Therefore, the time up to the stop of rapid cooling after the completion of rolling is preferably within 0.30 seconds, further preferably within 0.20 seconds. As the temperature at which rapid cooling stops is lower, the metallic structure of hot-rolled steel sheet is made finer. Therefore, it is preferable that the steel sheet be rapidly cooled to the temperature region of 760° C. or lower after the completion of rolling. It is further preferable that the steel sheet be rapidly cooled to the temperature region of 740° C. or lower after the completion of rolling, and it is still further preferable that the steel sheet be rapidly cooled to the temperature region of 720° C. or lower after the completion of rolling. Also, as the average cooling rate during rapid cooling is higher, the release of work strain is restrained. Therefore, the average cooling rate during rapid cooling is preferably made 300° C./s or higher. Thereby, the metallic structure of hot-rolled steel sheet can be made still finer. The average cooling rate during rapid cooling is further preferably made 400° C./s or higher, and still further preferably made 600° C./s or higher. The time from the completion of rolling to the start of rapid cooling and the cooling rate during the time need not be defined specially.

The equipment for performing rapid cooling is not defined specially; however, on the industrial basis, the use of a water spraying apparatus having a high water amount density is suitable. A method is cited in which a water spray header is arranged between rolled sheet conveying rollers, and high-pressure water having a sufficient water amount density is sprayed from the upside and downside of the rolled sheet.

After the stop of rapid cooling, the steel sheet is coiled in the temperature region of higher than 400° C. Since the coiling temperature is higher than 400° C., iron carbides precipitate sufficiently in the hot-rolled steel sheet. The iron carbides have an effect of restraining the coarsening of metallic structure after annealing. The coiling temperature is preferably higher than 500° C., further preferably higher than 550° C., and still further preferably higher than 580° C. On the other hand, if the coiling temperature is too high, in the hot-rolled steel sheet, ferrite is coarse, and the metallic structure after cold rolling and annealing is coarsened.

Therefore, the coiling temperature is preferably made lower than 650° C., further preferably made lower than 620° C. The conditions from the stop of rapid cooling to the coiling are not defined specially; however, after the stop of rapid cooling, the steel sheet is preferably held in the temperature region of 720 to 600° C. for one second or longer. Thereby, the formation of fine ferrite is promoted. On the other hand, if the holding time is too long, the productivity is impaired. Therefore, the upper limit of holding time in the temperature region of 720 to 600° C. is preferably made within 10 seconds. After being held in the temperature region of 720 to 600° C., the steel sheet is preferably cooled to the coiling temperature at a cooling rate of 20° C./s or higher to prevent the coarsening of formed ferrite.

For the hot-rolled steel sheet obtained by the above-described hot rolling, the average grain size of bcc grains calculated by the above-described method is preferably 6.0 μm or smaller, further preferably 4.0 μm or smaller, and still further preferably 3.5 μm or smaller.

Also, the average number density of iron carbides existing in the metallic structure is preferably $1.0\times10^{-1}/\mu m^2$ or higher, further preferably $5.0\times10^{-1}/\mu m^2$ or higher, and still further preferably $8.0\times10^{-1}/\mu m^2$ or higher.

(Cold-Rolling Process in Second Invention)

The hot-rolled steel sheet obtained by the above-described hot rolling is cold-rolled pursuant to an ordinary method. Before the cold rolling, the hot-rolled steel sheet may be descaled by pickling or the like means. In the cold rolling, to homogenize the metallic structure after cold rolling and annealing by means of promotion of recrystallization, and to further improve the stretch flanging property, the cold rolling ratio is preferably made 40% or higher, further preferably made higher than 50%. Thereby, the metallic structure after annealing is made still finer, and the aggregate structure is improved, so that the ductility, work hardening property, and stretch flanging property are further improved. From this viewpoint, the cold rolling ratio is further preferably made more than 60%, most preferably made more than 65%. On the other hand, if the cold rolling ratio is too high, the rolling load is increased, and it is difficult to perform rolling. Therefore, the upper limit of cold rolling ratio is preferably made lower than 80%, further preferably made lower than 70%.

(Annealing Process in Second Invention)

The cold-rolled steel sheet obtained by the above-described cold rolling is annealed in the same way as the annealing process in the first invention.

(Hot-Rolling Process in Third Invention)

Up to hot rolling and subsequent immediate rapid cooling, the hot-rolling process in the third invention is the same as that in the second invention. After the stop of rapid cooling, the steel sheet is coiled in the temperature region of lower than 400° C., and the obtained hot-rolled steel sheet is subjected to hot-rolled sheet annealing.

By making the coiling temperature lower than 400° C., at the time of next hot-rolled sheet annealing, iron carbides can be precipitated finely, and the metallic structure after cold rolling and subsequent annealing is made fine. The coiling temperature in this case is preferably lower than 300° C., further preferably lower than 200° C., and still further preferably lower than 100° C. The coiling temperature may be room temperature.

The hot-rolled steel sheet coiled at a temperature lower than 400° C. as described above is subjected to degreasing and the like treatment as necessary pursuant to a publicly-known method, and thereafter is annealed. The annealing performed on a hot-rolled steel sheet is called hot-rolled sheet annealing, and the steel sheet having been subjected to the hot-rolled sheet annealing is called a hot-rolled and annealed steel sheet. Before the hot-rolled sheet annealing, the steel sheet may be descaled by pickling or the like means. With the increase in heating temperature in the hot-rolled sheet annealing, Mn or Cr is concentrated in iron carbides, and the function of preventing the coarsening of austenite grains due to iron carbides is increased. Therefore, the lower limit of heating temperature is made higher than 300° C. The lower limit of heating temperature is preferably made higher than 400° C., further preferably made higher than 500° C., and still further preferably made higher than 600° C. On the other hand, if the heating temperature is too high, the coarsening and re-dissolving of iron carbides occur, and the effect of preventing the coarsening of austenite grains is impaired. Therefore, the upper limit of heating temperature is preferably made lower than 750° C., further preferably made lower than 700° C., and still further preferably made lower than 650° C.

The holding time in the hot-rolled sheet annealing need not be subject to any special restriction. For the hot-rolled steel sheet produced through a suitable immediate rapid cooling process, the metallic structure is fine, the precipitation sites of iron carbides are many, and iron carbides precipitate rapidly. Therefore, the steel sheet need not be held for a long period of time. Long holding time degrades the productivity. Therefore, the upper limit of holding time is preferably shorter than 20 hours, further preferably shorter than 10 hours, and still further preferably shorter than 5 hours.

For the hot-rolled and annealed steel sheet obtained by the above-described method, the average grain size of bcc grains calculated by the above-described method is preferably 6.0 μm or smaller, further preferably 4.0 μm or smaller, and still further preferably 3.5 μm or smaller.

Also, the average number density of iron carbides existing in the metallic structure is preferably $1.0\times10^{-1}/\mu m^2$ or higher, further preferably $5.0\times10^{1}/\mu m^2$ or higher, and still further preferably $8.0\times10^{-1}/\mu m^2$ or higher.

(Cold-Rolling Process in Third Invention)

The hot-rolled steel sheet obtained by the above-described hot rolling is cold-rolled in the same way as the cold-rolling process in the second invention.

(Annealing Process in Third Invention)

The cold-rolled steel sheet obtained by the above-described cold rolling is annealed in the same way as the annealing process in the first and second inventions.

The following examples merely illustrate the present invention, and do not intend to limit the present invention.

Example 1

Example 1 describes an example of the case where in the metallic structure of hot-rolled steel sheet, the average grain size of bcc grains surrounded by a grain boundary having an orientation difference of 15° or larger is 6.0 μm or smaller.

By using an experimental vacuum melting furnace, steels each having the chemical composition given in Table 1 were melted and cast. These ingots were formed into 30-mm thick billets by hot forging. The billets were heated to 1200° C. by using an electric heating furnace and held for 60 minutes, and thereafter were hot-rolled under the conditions given in Table 2.

Specifically, by using an experimental hot-rolling mill, 6-pass rolling was performed in the temperature region of $Ar_3$ point or higher to finish each of the billets into a steel sheet having a thickness of 2 to 3 mm. The draft of the final one pass was set at 12 to 42% in thickness decrease percentage. After hot rolling, the steel sheet was cooled to a temperature of 650 to 720° C. under various cooling conditions by using a water spray. Successively, after having been allowed to cool for 5 to 10 seconds, the steel sheet was cooled to various temperatures at a cooling rate of 60° C./s, and these temperatures were taken as coiling temperatures. The steel sheet was charged into an electric heating furnace that was held at that temperature, and was held for 30 minutes. Thereafter, the gradual cooling after coiling was simulated by furnace-cooling the steel sheet to room temperature at a cooling rate of 20° C./h, whereby a hot-rolled steel sheet was obtained.

A test specimen for EBSP measurement was sampled from the obtained hot-rolled steel sheet, and the longitudinal cross sectional surface thereof parallel to the rolling direction was electropolished. Thereafter, the metallic structure was observed at a position deep by one-fourth of thickness from the surface of steel sheet, and by image analysis, the average grain size of bcc grains was measured. Specifically, as an EBSP measuring device, OIM™5 manufactured by TSL Corporation was used, electron beams were applied at a pitch of 0.1 μm in a region having a size of 50 μm in the sheet thickness direction and 100 μm in the rolling direction, and among the obtained measured data, the data in which the reliability index was 0.1 or more was used as effective data to make judgment of bcc grains. With a region surrounded by a grain boundary having an orientation difference of 15° or larger being made one bcc grain, the circle corresponding diameter and area of individual bcc grain were determined, and the average grain size of bcc grains was calculated pursuant to the aforementioned formula (5). In calculating the average grain size, the bcc grains each having a circle corresponding diameter of 0.47 μm or larger were made effective bcc grains. As described before, in the metallic structure evaluation using the EBSP, the lattice constant is not considered. Therefore, grains each having a bet (body-centered tetragonal lattice) structure such as martensite are also measured together. Therefore, the bcc grains include both of the grains having a bcc structure and the grains having a bet structure.

The obtained hot-rolled steel sheet was pickled to form a base metal for cold rolling. The base metal was cold-rolled at a cold rolling ratio of 50 to 60%, whereby a cold-rolled, steel sheet having a thickness of 1.0 to 1.2 mm was obtained. By using a continuous annealing simulator, the obtained cold-rolled steel sheet was heated to 550° C. at a heating rate of 10° C./s, thereafter being heated to various temperatures given in Table 2 at a heating rate of 2° C./s, and was soaked for 95 seconds. Subsequently, the steel sheet was cooled to various cooling stop temperatures given in Table 2 with the average cooling rate from 700° C. being 60° C./s, being held at that temperature for 330 seconds, and thereafter was cooled to room temperature, whereby an annealed steel sheet was obtained.

TABLE 1

| | Chemical composition (mass %) (remainder: Fe and impurities) | | | | | | | | $Ac_3$ point | $Ar_3$ point |
|---|---|---|---|---|---|---|---|---|---|---|
| Steel | C | Si | Mn | P | S | sol.Al | N | Others | (° C.) | (° C.) |
| A | 0.124 | 0.05* | 2.97 | 0.011 | 0.003 | 0.031 | 0.0041 | | 792 | 698 |
| B | 0.145 | 0.99 | 2.49 | 0.012 | 0.004 | 0.029 | 0.0048 | | 836 | 742 |
| C | 0.147 | 0.98 | 2.48 | 0.011 | 0.003 | 0.030 | 0.0038 | Nb: 0.011 | 840 | 753 |
| D | 0.145 | 1.25 | 2.49 | 0.010 | 0.001 | 0.049 | 0.0030 | | 846 | 742 |
| E | 0.149 | 1.49 | 2.48 | 0.010 | 0.001 | 0.050 | 0.0035 | | 862 | 752 |
| F | 0.146 | 1.25 | 2.48 | 0.009 | 0.001 | 0.150 | 0.0032 | Nb: 0.010 | 874 | 764 |
| G | 0.166 | 1.51 | 2.53 | 0.010 | 0.001 | 0.048 | 0.0032 | Nb: 0.011 | 856 | 741 |
| H | 0.174 | 1.26 | 2.50 | 0.008 | 0.001 | 0.050 | 0.0032 | Nb: 0.013 | 839 | 742 |
| I | 0.176 | 1.26 | 2.51 | 0.008 | 0.001 | 0.051 | 0.0031 | Nb: 0.011 | 843 | 736 |
| J | 0.175 | 1.25 | 2.50 | 0.008 | 0.001 | 0.050 | 0.0033 | Ti: 0.021 | 848 | 750 |
| K | 0.175 | 1.30 | 2.53 | 0.008 | 0.001 | 0.045 | 0.0030 | Nb: 0.010 | 849 | 731 |
| L | 0.184 | 1.28 | 2.24 | 0.009 | 0.001 | 0.050 | 0.0032 | Nb: 0.011 | 854 | 754 |
| M | 0.203 | 1.28 | 1.93 | 0.009 | 0.001 | 0.051 | 0.0027 | Nb: 0.011 | 855 | 768 |
| N | 0.197 | 1.26 | 1.92 | 0.009 | 0.001 | 0.140 | 0.0033 | Nb: 0.010 | 870 | 781 |
| O | 0.198 | 1.26 | 2.22 | 0.009 | 0.001 | 0.143 | 0.0031 | Nb: 0.011 | 855 | 758 |
| P | 0.197 | 1.28 | 2.24 | 0.009 | 0.001 | 0.151 | 0.0029 | Nb: 0.011 Cr: 0.30 | 848 | 786 |
| Q | 0.150 | 1.51 | 2.51 | 0.008 | 0.001 | 0.052 | 0.0034 | V: 0.11 REM: 0.0006 | 872 | 783 |
| R | 0.151 | 1.50 | 2.52 | 0.009 | 0.001 | 0.047 | 0.0031 | Bi: 0.008 | 862 | 772 |
| S | 0.149 | 1.25 | 2.47 | 0.009 | 0.001 | 0.152 | 0.0033 | Ca: 0.0009 Mg: 0.0007 | 864 | 775 |
| T | 0.148 | 1.26 | 2.48 | 0.009 | 0.001 | 0.141 | 0.0030 | Mo: 0.10 B: 0.0015 | 877 | 741 |

Note)

1. $Ac_3$ point was determined from thermal expansion change at the time when cold-rolled steel sheet was heated at 2° C./s.

2. $Ar_3$ point was determined from thermal expansion change at the time when cold-rolled steel sheet was heated to 900° C. and thereafter was cooled at 0.01° C./s.

TABLE 2

| | | Hot-rolling condition | | | | | | | | Annealing condition | |
|---|---|---|---|---|---|---|---|---|---|---|---|
| Test No. | Steel | Final pass draft (%) | Sheet thickness after rolling[1)] (mm) | Rolling finishing temperature (° C.) | Rapid cooling stop temperature (° C.) | Time up to rapid cooling stop[2)] (s) | Average cooling rate[3)] (° C./s) | Coiling temperature (° C.) | Average grain size of bcc grains of hot-rolled steel sheet (μm) | Soaking temperature (° C.) | Cooling stop temperature (° C.) |
| 1 | A* | 22 | 2.0 | 830 | 650 | 0.17 | 1200 | 600 | 6.3* | 850 | 400 |
| 2 | B | 25 | 3.0 | 830 | 680 | 4.14 | 61 | 600 | 7.8* | 820 | 350 |
| 3 | B | 25 | 3.0 | 840 | 710 | 0.20 | 722 | 600 | 5.1 | 790* | 350 |

TABLE 2-continued

| Test No. | Steel | Hot-rolling condition: Final pass draft (%) | Sheet thickness after rolling[1)] (mm) | Rolling finishing temperature (° C.) | Rapid cooling stop temperature (° C.) | Time up to rapid cooling stop[2)] (s) | Average cooling rate[3)] (° C./s) | Coiling temperature (° C.) | Average grain size of bcc grains of hot-rolled steel sheet (μm) | Annealing condition: Soaking temperature (° C.) | Cooling stop temperature (° C.) |
|---|---|---|---|---|---|---|---|---|---|---|---|
| 4 | C | 25 | 3.0 | 830 | 670 | 4.14 | 65 | 600 | 7.3* | 820 | 350 |
| 5 | D | 42 | 2.0 | 900 | 660 | 0.18 | 1500 | 520 | 2.7 | 850 | 375 |
| 6 | E | 33 | 2.0 | 900 | 660 | 0.17 | 1600 | 600 | 3.5 | 850 | 350 |
| 7 | E | 42 | 2.0 | 900 | 660 | 0.18 | 1500 | 560 | 2.8 | 850 | 350 |
| 8 | F | 33 | 2.0 | 900 | 660 | 0.17 | 1600 | 520 | 3.3 | 850 | 375 |
| 9 | G | 33 | 2.0 | 900 | 650 | 0.17 | 1667 | 540 | 3.4 | 865 | 350 |
| 10 | H | 22 | 2.0 | 900 | 720 | 5.52 | 51 | 600 | 6.8* | 850 | 350 |
| 11 | I | 42 | 2.0 | 900 | 660 | 0.18 | 1500 | 560 | 2.7 | 850 | 425 |
| 12 | J | 42 | 2.0 | 900 | 660 | 0.18 | 1500 | 560 | 2.6 | 850 | 400 |
| 13 | K | 12 | 2.0 | 900 | 660 | 0.15 | 1846 | 560 | 6.3* | 850 | 375 |
| 14 | K | 22 | 2.0 | 900 | 660 | 0.17 | 1600 | 560 | 4.8 | 850 | 375 |
| 15 | K | 33 | 2.0 | 900 | 660 | 0.17 | 1600 | 600 | 3.7 | 790* | 400 |
| 16 | K | 33 | 2.0 | 900 | 660 | 0.17 | 1600 | 560 | 3.3 | 850 | 325 |
| 17 | L | 33 | 2.0 | 900 | 660 | 0.17 | 1600 | 600 | 3.5 | 850 | 400 |
| 18 | L | 42 | 2.0 | 900 | 660 | 0.18 | 1500 | 560 | 2.6 | 850 | 400 |
| 19 | M | 33 | 2.0 | 900 | 670 | 0.17 | 1533 | 600 | 3.3 | 850 | 350 |
| 20 | M | 42 | 2.0 | 900 | 660 | 0.18 | 1500 | 560 | 2.7 | 850 | 400 |
| 21 | N | 33 | 2.0 | 900 | 660 | 0.18 | 1500 | 510 | 3.4 | 850 | 400 |
| 22 | O | 33 | 2.0 | 900 | 670 | 0.17 | 1533 | 520 | 3.5 | 850 | 400 |
| 23 | P | 33 | 2.0 | 900 | 660 | 0.18 | 1500 | 510 | 3.2 | 850 | 350 |
| 24 | Q | 42 | 2.0 | 900 | 650 | 0.18 | 1563 | 560 | 2.7 | 865 | 350 |
| 25 | R | 42 | 2.0 | 900 | 650 | 0.18 | 1563 | 560 | 2.7 | 865 | 350 |
| 26 | S | 42 | 2.0 | 900 | 660 | 0.18 | 1500 | 560 | 2.9 | 865 | 400 |
| 27 | T | 42 | 2.0 | 900 | 660 | 0.18 | 1500 | 560 | 2.8 | 865 | 400 |

[1)]Sheet thickness of hot-rolled steel sheet.
[2)]Time from rolling completion to rapid cooling stop.
3) Average cooling rate during rapid cooling.

A test specimen for SEM observation was sampled from the annealed steel sheet, and the longitudinal cross sectional surface thereof parallel to the rolling direction was polished. Thereafter, the metallic structure was observed at a position deep by one-fourth of thickness from the surface of steel sheet, and by image processing, the volume fractions of low-temperature transformation producing phase and polygonal ferrite were measured. Also, the average grain size (circle corresponding diameter) of polygonal ferrite was determined by dividing the area occupied by the whole of polygonal ferrite by the number of crystal grains of polygonal ferrite.

Also, a test specimen for XRD measurement was sampled from the annealed steel sheet, and the rolled surface down to a position deep by one-fourth of thickness from the surface of steel sheet was chemically polished. Thereafter, an X-ray diffraction test was conducted to measure the volume fraction of retained austenite. Specifically, RINT2500 manufactured by Rigaku Corporation was used as an X-ray diffractometer, and Co-Kα beams were applied to measure the integrated intensities of a phase (110), (200), (211) diffraction peaks and y phase (111), (200), (220) diffraction peaks, whereby the volume fraction of retained austenite was determined.

Furthermore, a test specimen for EBSP measurement was sampled from the annealed steel sheet, and the longitudinal cross sectional surface thereof parallel to the rolling direction was electropolished. Thereafter, the metallic structure was observed at a position deep by one-fourth of thickness from the surface of steel sheet, and by image analysis, the grain size distribution of retained austenite and the average grain size of retained austenite were measured. Specifically, as an EBSP measuring device, OIM™5 manufactured by TSL Corporation was used, electron beams were applied at a pitch of 0.1 μm in a region having a size of 50 μm in the sheet thickness direction and 100 μm in the rolling direction, and among the obtained data, the data in which the reliability index was 0.1 or more was used as effective data to make judgment of fcc phase. With a region that was observed as the fcc phase and was surrounded by a parent phase being made one retained austenite grain, the circle corresponding diameter of individual retained austenite grain was determined. The average grain size of retained austenite was calculated as the mean value of circle corresponding diameters of individual effective retained austenite grains, the effective retained austenite grains being retained austenite grains each having a circle corresponding diameter of 0.15 μm or larger. Also, the number density ($N_R$) per unit area of retained austenite grains each having a grain size of 1.2 μm or larger was determined.

The yield stress (YS) and tensile strength (TS) were determined by sampling a JIS No. 5 tensile test specimen along the direction perpendicular to the rolling direction from the annealed steel sheet, and by conducting a tension test at a tension rate of 10 mm/min. The total elongation (El) was determined as follows: a tension test was conducted by using a JIS No. 5 tensile test specimen sampled along the direction perpendicular to the rolling direction, and by using the obtained actually measured value ($El_0$), the converted value of total elongation corresponding to the case where the sheet thickness is 1.2 mm was determined based on formula (1) above. The work hardening index (n value) was determined with the strain range being 5 to 10% by conducting a tension test by using a JIS No. 5 tensile test specimen sampled along the direction perpendicular to the rolling direction. Specifically, the n value was calculated by the two point method by using test forces with respect to nominal strains of 5% and 10%.

The stretch flanging property was evaluated by measuring the bore expanding ratio (λ) by the method described below. From the annealed steel sheet, a 100-mm square bore expanding test specimen was sampled. A 10-mm diameter punched hole was formed with a clearance being 12.5%, the punched hole was expanded from the shear drop side by using a cone-shaped punch having a front edge angle of 60°, and the expansion ratio of the hole at the time when a crack penetrating the sheet thickness was generated was measured. This expansion ratio was used as the bore expanding ratio.

Table 3 gives the metallic structure observation results and the performance evaluation results of the cold-rolled steel sheet after being annealed. In Tables 1 to 3, mark "*" attached to a symbol or numeral indicates that the symbol or numeral is out of the range of the present invention.

and the cooling stop temperature after annealing was 340° C. or higher were the value of TS×El being 19,000 MPa % or higher, the value of TS×n value being 160 or higher, and the value of $TS^{1.7}\times\lambda$ being 5,500,000 $MPa^{1.7}$% or higher, exhibiting especially excellent ductility, work hardening property, and stretch flanging property.

Example 2

Example 2 describes an example of the case where in the metallic structure of hot-rolled steel sheet, the average grain size of bcc grains surrounded by a grain boundary having an orientation difference of 15° or larger is 6.0 μm or smaller, and the average number density of iron carbides is $1.0\times10^{-1}/\mu m^2$ or higher.

TABLE 3

| | | | | Metallic structure of cold-rolled steel sheet (%: volume ratio) | | | | | | | | | | | | | |
|---|---|---|---|---|---|---|---|---|---|---|---|---|---|---|---|---|---|
| | | Cold-rolled steel sheet | Cold | Low-temperature transformation pro- | | | Average grain size (μm) | | $N_R$[2] | | | | | | TS × | TS × | $TS^{1.7}$ × |
| Test No. | Steel | thickness (mm) | rolling ratio[1] (%) | ducing phase (%) | Retained γ (%) | Polygonal α (%) | Retained γ | Polygonal α | (number/ $\mu m^2$) | YS (MPa) | TS (MPa) | El (%) | n value | λ (%) | El (MPa %) | n value (MPa) | λ $MPa^{1.7}$ % |
| 1 | A* | 1.0 | 50 | 78 | 4.0 | 18 | 0.81 | 6.4 | 0.005 | 502 | 716 | 24.8 | 0.175 | 47 | 17757 | 125 | 3353127 |
| 2 | B | 1.2 | 60 | 64 | 10 | 26 | 0.82 | 6.8 | 0.037 | 503 | 978 | 17.1 | 0.148 | 35 | 16724 | 145 | 4242717 |
| 3 | B | 1.2 | 60 | 39 | 8 | 53 | 0.83 | 4.8 | 0.039 | 520 | 1056 | 15.5 | 0.159 | 32 | 16368 | 168 | 4419556 |
| 4 | C | 1.2 | 60 | 64 | 8 | 28 | 0.71 | 7.3 | 0.036 | 511 | 1020 | 16.0 | 0.143 | 33 | 16320 | 146 | 4296692 |
| 5 | D | 1.0 | 50 | 86 | 7 | 7 | 0.42 | 1.4 | 0.006 | 521 | 952 | 22.1 | 0.202 | 83 | 21039 | 192 | 9610830 |
| 6 | E | 1.0 | 50 | 80 | 8 | 12 | 0.44 | 2.5 | 0.007 | 512 | 963 | 22.3 | 0.200 | 57 | 21475 | 193 | 6730379 |
| 7 | E | 1.0 | 50 | 78 | 8 | 14 | 0.43 | 3.2 | 0.006 | 519 | 964 | 22.1 | 0.189 | 74 | 21304 | 182 | 8753116 |
| 8 | F | 1.0 | 50 | 73 | 10 | 17 | 0.55 | 3.2 | 0.018 | 606 | 1003 | 21.5 | 0.167 | 57 | 21565 | 168 | 7212510 |
| 9 | G | 1.0 | 50 | 83 | 8 | 9 | 0.52 | 1.6 | 0.015 | 633 | 1095 | 18.9 | 0.161 | 66 | 20696 | 176 | 9695003 |
| 10 | H | 1.0 | 50 | 90 | 8 | 2.0 | 0.74 | 0.6 | 0.036 | 760 | 1084 | 17.3 | 0.136 | 29 | 18753 | 147 | 4187432 |
| 11 | I | 1.0 | 50 | 80 | 15 | 5 | 0.50 | 0.8 | 0.014 | 685 | 1034 | 23.4 | 0.186 | 48 | 24196 | 192 | 6396261 |
| 12 | J | 1.0 | 50 | 80 | 14 | 6 | 0.51 | 1.0 | 0.013 | 670 | 1023 | 22.9 | 0.190 | 49 | 23427 | 194 | 6411869 |
| 13 | K | 1.0 | 50 | 90 | 8 | 2.0 | 0.71 | 0.9 | 0.036 | 736 | 1040 | 18.2 | 0.143 | 30 | 18928 | 149 | 4037178 |
| 14 | K | 1.0 | 50 | 86 | 9 | 5 | 0.64 | 1.2 | 0.032 | 732 | 1047 | 18.7 | 0.146 | 35 | 19579 | 153 | 4764062 |
| 15 | K | 1.0 | 50 | 42 | 13 | 45 | 0.82 | 6.9 | 0.040 | 642 | 990 | 20.5 | 0.196 | 27 | 20295 | 194 | 3341516 |
| 16 | K | 1.0 | 50 | 85 | 8 | 7 | 0.59 | 2.0 | 0.031 | 762 | 1094 | 16.2 | 0.143 | 35 | 17723 | 156 | 5133310 |
| 17 | L | 1.0 | 50 | 78 | 12 | 10 | 0.51 | 2.2 | 0.013 | 501 | 930 | 23.5 | 0.243 | 55 | 21855 | 226 | 6120455 |
| 18 | L | 1.0 | 50 | 77 | 13 | 10 | 0.51 | 2.0 | 0.014 | 457 | 937 | 22.3 | 0.243 | 54 | 20895 | 228 | 6086268 |
| 19 | M | 1.0 | 50 | 65 | 10 | 25 | 0.54 | 4.7 | 0.018 | 569 | 985 | 22.6 | 0.172 | 52 | 22261 | 169 | 6380356 |
| 20 | M | 1.0 | 50 | 61 | 13 | 26 | 0.62 | 4.8 | 0.025 | 575 | 901 | 26.4 | 0.184 | 59 | 23786 | 166 | 6221343 |
| 21 | N | 1.0 | 50 | 61 | 14 | 25 | 0.65 | 4.5 | 0.028 | 527 | 879 | 27.1 | 0.193 | 64 | 23821 | 170 | 6470846 |
| 22 | O | 1.0 | 50 | 74 | 12 | 14 | 0.55 | 2.3 | 0.021 | 693 | 993 | 22.2 | 0.169 | 53 | 22045 | 168 | 6593099 |
| 23 | P | 1.0 | 50 | 85 | 11 | 4 | 0.43 | 0.7 | 0.008 | 571 | 1071 | 19.3 | 0.187 | 49 | 20670 | 200 | 6931675 |
| 24 | Q | 1.0 | 50 | 77 | 8 | 15 | 0.42 | 2.9 | 0.006 | 587 | 1011 | 21.5 | 0.192 | 77 | 21737 | 194 | 9875695 |
| 25 | R | 1.0 | 50 | 77 | 9 | 14 | 0.41 | 2.8 | 0.007 | 535 | 986 | 21.6 | 0.199 | 72 | 21298 | 196 | 8849592 |
| 26 | S | 1.0 | 50 | 84 | 9 | 7 | 0.43 | 1.4 | 0.007 | 699 | 1061 | 20.3 | 0.177 | 86 | 21538 | 188 | 11973320 |
| 27 | T | 1.0 | 50 | 73 | 10 | 17 | 0.47 | 2.5 | 0.010 | 534 | 999 | 22.8 | 0.212 | 75 | 22777 | 212 | 9425895 |

[1]Cold rolling ratio: Total draft of cold rolling;
[2]$N_R$: Number density of retained austenite grain having grain size of 1.2 μm or larger;
[3]El: Total elongation converted so as to correspond to 1.2 mm thickness,
λ: Bore expanding ratio,
n value: work hardening index All of the test results of cold-rolled steel sheets produced under the conditions defined in the present invention were the value of TS×El being 15,000 MPa % or higher, the value of TS×n value being 150 or higher, and the value of $TS^{1.7}\times\lambda$ being 4,500,000 $MPa^{1.7}$% or higher, exhibiting excellent ductility, work hardening property, and stretch flanging property. In particular, all of the test results of the metallic structure of hot-rolled steel sheet in which the average grain size of bcc grains surrounded by a grain boundary having an orientation difference of 15° or larger was 4.0 μm or smaller, By using an experimental vacuum melting furnace, steels each having the chemical composition given in Table 4 were melted and cast. These ingots were formed into 30-mm thick billets by hot forging. The billets were heated to 1200° C. by using an electric heating furnace and held for 60 minutes, and thereafter were hot-rolled under the conditions given in Table 5.

Specifically, by using an experimental hot-rolling mill, 6-pass rolling was performed in the temperature region of $Ar_3$ point or higher to finish each of the billets into a steel sheet having a thickness of 2 to 3 mm. The draft of the final one pass was set at 22 to 42% in thickness decrease percentage. After hot rolling, the steel sheet was cooled to a temperature of 650 to 720° C. under various cooling conditions by using a water spray. Successively, after having been allowed to cool for 5 to 10 seconds, the steel sheet was cooled to various temperatures at a cooling rate of 60° C./s, and these temperatures were taken as coiling temperatures. The steel sheet was charged into an electric heating furnace that was held at that temperature, and was held for 30 minutes. Thereafter, the gradual cooling after coiling was simulated by furnace-cooling the steel sheet to room temperature at a cooling rate of 20° C./h, whereby a hot-rolled steel sheet was obtained.

The obtained hot-rolled steel sheet was heated to various heating temperatures given in Table 5 at a heating rate of 50° C./h. After being held for various periods of time or without being held, the steel sheet was cooled to room temperature at a cooling rate of 20° C./h, whereby a hot-rolled and annealed steel sheet was obtained.

The average grain size of bcc grains of the obtained hot-rolled and annealed steel sheet was measured by the method described in Example 1. Also, the average number density of iron carbides of the hot-rolled and annealed steel sheet was determined by the method using the aforementioned SEM and Auger electron spectroscope.

Next, the obtained hot-rolled and annealed steel sheet was pickled to form a base metal for cold rolling. The base metal was cold-rolled at a cold rolling ratio of 50 to 60%, whereby a cold-rolled steel sheet having a thickness of 1.0 to 1.2 mm was obtained. By using a continuous annealing simulator, the obtained cold-rolled steel sheet was heated to 550° C. at a heating rate of 10° C./s, thereafter being heated to various temperatures given in Table 5 at a heating rate of 2° C./s, and was soaked for 95 seconds. Subsequently, the steel sheet was cooled to various cooling stop temperatures given in Table 2 with the average cooling rate from 700° C. being 60° C./s, being held at that temperature for 330 seconds, and thereafter was cooled to room temperature, whereby an annealed steel sheet was obtained.

TABLE 4

| | Chemical composition (mass %) (remainder: Fe and impurities) | | | | | | | | $Ac_3$ point | $Ar_3$ point |
|---|---|---|---|---|---|---|---|---|---|---|
| Steel | C | Si | Mn | P | S | sol.A1 | N | Others | (° C.) | (° C.) |
| A | 0.124 | 0.05* | 2.97 | 0.011 | 0.003 | 0.031 | 0.0041 | | 792 | 698 |
| B | 0.145 | 0.99 | 2.49 | 0.012 | 0.004 | 0.029 | 0.0048 | | 836 | 742 |
| C | 0.143 | 1.23 | 2.50 | 0.009 | 0.001 | 0.052 | 0.0028 | Nb: 0.011 | 849 | 756 |
| D | 0.138 | 1.49 | 2.50 | 0.009 | 0.001 | 0.053 | 0.0026 | Nb: 0.011 | 872 | 757 |
| E | 0.149 | 1.49 | 2.48 | 0.010 | 0.001 | 0.050 | 0.0035 | | 862 | 752 |
| F | 0.146 | 1.23 | 2.45 | 0.009 | 0.001 | 0.140 | 0.0031 | | 861 | 770 |
| G | 0.151 | 1.52 | 2.81 | 0.010 | 0.001 | 0.045 | 0.0030 | Nb: 0.011 | 849 | 760 |
| H | 0.166 | 1.51 | 2.53 | 0.010 | 0.001 | 0.048 | 0.0032 | Nb: 0.011 | 856 | 741 |
| I | 0.174 | 1.26 | 2.50 | 0.008 | 0.001 | 0.050 | 0.0032 | Nb: 0.013 | 839 | 742 |
| J | 0.176 | 1.26 | 2.51 | 0.008 | 0.001 | 0.051 | 0.0031 | Nb: 0.011 | 843 | 736 |
| K | 0.175 | 1.25 | 2.50 | 0.008 | 0.001 | 0.050 | 0.0033 | Ti: 0.021 | 848 | 750 |
| L | 0.203 | 1.28 | 1.93 | 0.009 | 0.001 | 0.051 | 0.0027 | Nb: 0.011 | 855 | 768 |
| M | 0.197 | 1.26 | 1.92 | 0.009 | 0.001 | 0.140 | 0.0033 | Nb: 0.010 | 870 | 781 |
| N | 0.197 | 1.28 | 2.24 | 0.009 | 0.001 | 0.151 | 0.0029 | Nb: 0.011 Cr: 0.30 | 848 | 786 |
| O | 0.150 | 1.51 | 2.51 | 0.008 | 0.001 | 0.052 | 0.0034 | V: 0.11 REM: 0.0006 | 872 | 783 |
| P | 0.151 | 1.50 | 2.52 | 0.009 | 0.001 | 0.047 | 0.0031 | Bi: 0.008 | 862 | 772 |
| Q | 0.149 | 1.25 | 2.47 | 0.009 | 0.001 | 0.152 | 0.0033 | Ca: 0.0009 Mg: 0.0007 | 864 | 775 |
| R | 0.148 | 1.26 | 2.48 | 0.009 | 0.001 | 0.141 | 0.0030 | Mo: 0.10 B: 0.0015 | 877 | 741 |

Note)

1. $Ac_3$ point was determined from thermal expansion change at the time when cold-rolled steel sheet was heated at 2° C./s.

2. $Ar_3$ point was determined from thermal expansion change at the time when cold-rolled steel sheet was heated to 900° C. and thereafter was cooled at 0.01° C./s.

TABLE 5

| | | | Hot-rolling condition | | | | | | Hot-rolled sheet annealing | | Hot-rolled and annealed steel sheet | | Annealing condition | |
|---|---|---|---|---|---|---|---|---|---|---|---|---|---|---|
| Test No. | Steel | Final pass draft (%) | Sheet thickness after rolling[1)] (mm) | Rolling finishing temperature (° C.) | Rapid cooling stop temperature (° C.) | Time up to rapid cooling stop[2)] (s) | Average cooling rate[3)] (° C./s) | Coiling temperature[4)] (° C.) | Heating temperature (° C.) | Holding time[5)] (h) | Average grain size of bcc grains (μm) | Average number density of iron carbides (number/μm²) | Soaking temperature (° C.) | Cooling stop temperature (° C.) |
| 1 | A* | 22 | 2.0 | 830 | 650 | 0.17 | 1200 | 300 | 600 | 2 | 6.2* | $4.2 \times 10^{-1}$ | 850 | 400 |
| 2 | B | 25 | 3.0 | 830 | 680 | 4.14 | 61 | 200 | 600 | 1 | 7.3* | $<1.0 \times 10^{-1}$ | 820 | 350 |
| 3 | B | 25 | 3.0 | 840 | 710 | 0.20 | 722 | 200 | 600 | 1 | 5.6 | $6.8 \times 10^{-1}$ | 790* | 350 |
| 4 | C | 22 | 2.0 | 900 | 650 | 0.17 | 1667 | RT | 620 | 0 | 4.8 | $7.1 \times 10^{-1}$ | 850 | 325 |
| 5 | D | 33 | 2.0 | 900 | 660 | 0.17 | 1600 | RT | 620 | 0 | 3.3 | $8.5 \times 10^{-1}$ | 850 | 350 |
| 6 | E | 33 | 2.0 | 900 | 660 | 0.17 | 1600 | RT | 620 | 0 | 3.5 | $8.3 \times 10^{-1}$ | 850 | 350 |
| 7 | F | 33 | 2.0 | 900 | 660 | 0.17 | 1600 | RT | 620 | 0 | 3.5 | $8.1 \times 10^{-1}$ | 850 | 375 |
| 8 | G | 33 | 2.0 | 900 | 660 | 0.17 | 1600 | RT | 620 | 0 | 3.2 | $8.9 \times 10^{-1}$ | 850 | 350 |

TABLE 5-continued

| Test No. | Steel | Final pass draft (%) | Sheet thickness after rolling[1)] (mm) | Hot-rolling condition: Rolling finishing temperature (° C.) | Hot-rolling condition: Rapid cooling stop temperature (° C.) | Hot-rolling condition: Time up to rapid cooling stop[2)] (s) | Average cooling rate[3)] (° C./s) | Coiling temperature[4)] (° C.) | Hot-rolled sheet annealing: Heating temperature (° C.) | Hot-rolled sheet annealing: Holding time[5)] (h) | Hot-rolled and annealed steel sheet: Average grain size of bcc grains (μm) | Hot-rolled and annealed steel sheet: Average number density of iron carbides (number/μm$^2$) | Annealing condition: Soaking temperature (° C.) | Annealing condition: Cooling stop temperature (° C.) |
|---|---|---|---|---|---|---|---|---|---|---|---|---|---|---|
| 9 | H | 33 | 2.0 | 900 | 650 | 0.17 | 1667 | RT | 620 | 0 | 3.3 | $9.2 \times 10^{-1}$ | 850 | 350 |
| 10 | I | 22 | 2.0 | 900 | 720 | 5.52 | 51 | 200 | 500 | 2 | 7.8* | $<1.0 \times 10^{-1}$ | 850 | 350 |
| 11 | J | 33 | 2.0 | 900 | 660 | 0.18 | 1500 | RT | 620 | 0 | 3.4 | $9.8 \times 10^{-1}$ | 850 | 425 |
| 12 | J | 33 | 2.0 | 900 | 660 | 0.17 | 1600 | RT | 640 | 1 | 3.3 | 1.0 | 900 | 425 |
| 13 | K | 42 | 2.0 | 900 | 660 | 0.18 | 1500 | 150 | 640 | 1 | 2.8 | 1.1 | 850 | 400 |
| 14 | K | 33 | 2.0 | 900 | 660 | 0.17 | 1600 | RT | 640 | 1 | 3.2 | $9.9 \times 10^{-1}$ | 900 | 400 |
| 15 | L | 42 | 2.0 | 900 | 660 | 0.18 | 1500 | RT | 620 | 0 | 2.6 | 1.2 | 850 | 350 |
| 16 | M | 33 | 2.0 | 900 | 660 | 0.18 | 1500 | RT | 620 | 0 | 3.5 | 1.1 | 850 | 350 |
| 17 | N | 33 | 2.0 | 900 | 660 | 0.18 | 1500 | RT | 640 | 1 | 3.3 | 1.1 | 850 | 350 |
| 18 | O | 42 | 2.0 | 900 | 650 | 0.18 | 1563 | 100 | 640 | 1 | 2.7 | $9.3 \times 10^{-1}$ | 865 | 350 |
| 19 | P | 42 | 2.0 | 900 | 650 | 0.18 | 1563 | 100 | 640 | 1 | 2.6 | $9.1 \times 10^{-1}$ | 865 | 350 |
| 20 | Q | 42 | 2.0 | 900 | 660 | 0.18 | 1500 | 100 | 620 | 0 | 2.9 | $8.7 \times 10^{-1}$ | 865 | 400 |
| 21 | R | 42 | 2.0 | 900 | 660 | 0.18 | 1500 | RT | 620 | 0 | 2.7 | $8.8 \times 10^{-1}$ | 865 | 400 |

[1)]Sheet thickness of hot-rolled steel sheet.
[2)]Time from rolling completion to rapid cooling stop.
[3)]Average cooling rate during rapid cooling.
[4)]RT means room temperature.
[5)]0 h means that holding was not performed.

For the obtained annealed steel sheet, the volume fractions of low-temperature transformation producing phase, retained austenite, and polygonal ferrite, the average grain size of retained austenite, the number density ($N_R$) per unit area of retained austenite grains each having a grain size of 1.2 μm or larger, the yield stress (YS), the tensile strength (TS), the total elongation (El), the work hardening index (n value), and the bore expanding ratio (λ) were measured as described in Example 1. Table 6 gives the metallic structure observation results and the performance evaluation results of the cold-rolled steel sheet after being annealed. In Tables 4 to 6, mark "*" attached to a symbol or numeral indicates that the symbol or numeral is out of the range of the present invention.

TABLE 6

| Test No. | Steel | Cold-rolled steel sheet thickness (mm) | Cold rolling ratio[1)] (%) | Metallic structure of cold-rolled steel sheet (%: volume ratio): Low-temperature transformation producing phase (%) | Metallic structure: Retained austenite (%) | Metallic structure: Polygonal ferrite (%) | Metallic structure: Average grain size of retained austenite (μm) | Metallic structure: $N_R$[2)] (number/μm$^2$) | Mechanical property of cold-rolled steel sheet[3)]: YS (MPa) | TS (MPa) | El (%) | n value | λ (%) | TS × El (MPa %) | TS × n value (MPa) | TS$^{1.7}$ × λ (MPa$^{1.7}$ %) |
|---|---|---|---|---|---|---|---|---|---|---|---|---|---|---|---|---|
| 1 | A* | 1.0 | 50 | 76 | 3 | 21 | 0.83 | 0.006 | 496 | 705 | 24.0 | 0.172 | 48 | 16920 | 121 | 3335514 |
| 2 | B | 1.2 | 60 | 61 | 11 | 28 | 0.83 | 0.038 | 497 | 972 | 17.3 | 0.149 | 35 | 16816 | 145 | 4198563 |
| 3 | B | 1.2 | 60 | 35* | 10 | 55* | 0.81 | 0.038 | 515 | 1050 | 15.6 | 0.161 | 31 | 16380 | 169 | 4240172 |
| 4 | C | 1.0 | 50 | 84 | 7 | 9 | 0.78 | 0.033 | 676 | 981 | 16.5 | 0.162 | 57 | 16187 | 159 | 6945638 |
| 5 | D | 1.0 | 50 | 80 | 9 | 11 | 0.53 | 0.014 | 544 | 996 | 21.3 | 0.194 | 52 | 21215 | 193 | 6501959 |
| 6 | E | 1.0 | 50 | 82 | 7 | 11 | 0.42 | 0.008 | 538 | 988 | 20.7 | 0.178 | 53 | 20452 | 176 | 6536762 |
| 7 | F | 1.0 | 50 | 80 | 8 | 12 | 0.42 | 0.006 | 573 | 996 | 20.6 | 0.184 | 63 | 20518 | 183 | 7877373 |
| 8 | G | 1.0 | 50 | 86 | 10 | 4 | 0.59 | 0.018 | 619 | 1179 | 17.3 | 0.152 | 61 | 20397 | 179 | 10160224 |
| 9 | H | 1.0 | 50 | 82 | 9 | 9 | 0.51 | 0.011 | 565 | 1121 | 19.8 | 0.190 | 60 | 22196 | 213 | 9172354 |
| 10 | I | 1.0 | 50 | 89 | 9 | 2.0 | 0.72 | 0.036 | 759 | 1080 | 17.5 | 0.133 | 27 | 18900 | 144 | 3874219 |
| 11 | J | 1.0 | 50 | 81 | 15 | 4 | 0.55 | 0.017 | 727 | 1046 | 21.0 | 0.181 | 45 | 21966 | 189 | 6115280 |
| 12 | J | 1.0 | 50 | 85 | 14 | 1.0 | 0.65 | 0.028 | 691 | 1037 | 19.0 | 0.158 | 55 | 19703 | 164 | 7365234 |
| 13 | K | 1.0 | 50 | 77 | 16 | 7 | 0.53 | 0.015 | 662 | 1018 | 23.2 | 0.193 | 48 | 23618 | 196 | 6228916 |
| 14 | K | 1.0 | 50 | 83 | 15 | 2.0 | 0.62 | 0.027 | 702 | 1040 | 18.8 | 0.157 | 54 | 19552 | 163 | 7266921 |
| 15 | L | 1.0 | 50 | 68 | 9 | 23 | 0.63 | 0.021 | 558 | 995 | 21.6 | 0.169 | 52 | 21492 | 168 | 6490865 |
| 16 | M | 1.0 | 50 | 65 | 11 | 24 | 0.65 | 0.022 | 545 | 995 | 21.7 | 0.166 | 46 | 21592 | 165 | 5741919 |
| 17 | N | 1.0 | 50 | 81 | 13 | 6 | 0.48 | 0.009 | 567 | 1066 | 19.9 | 0.190 | 48 | 21213 | 203 | 6736410 |
| 18 | O | 1.0 | 50 | 76 | 8 | 16 | 0.44 | 0.006 | 584 | 1010 | 21.4 | 0.191 | 77 | 21614 | 193 | 9859095 |
| 19 | P | 1.0 | 50 | 76 | 10 | 14 | 0.42 | 0.006 | 537 | 986 | 21.8 | 0.198 | 71 | 21495 | 195 | 8726681 |

TABLE 6-continued

| | | | | Metallic structure of cold-rolled steel sheet (%: volume ratio) | | | | | Mechanical property of cold-rolled steel sheet[3)] | | | | | | | |
|---|---|---|---|---|---|---|---|---|---|---|---|---|---|---|---|---|
| Test No. | Steel | Cold-rolled steel sheet thickness (mm) | Cold rolling ratio[1)] (%) | Low-temperature transformation producing phase (%) | Retained austenite (%) | Polygonal ferrite (%) | Average grain size of retained austenite (μm) | $N_R$[2)] (number/μm$^2$) | YS (MPa) | TS (MPa) | El (%) | n value | λ (%) | TS × El (MPa %) | TS × n value (MPa) | TS$^{1.7}$ × λ (MPa$^{1.7}$ %) |
| 20 | Q | 1.0 | 50 | 83 | 9 | 8 | 0.44 | 0.007 | 693 | 1059 | 20.2 | 0.178 | 84 | 21392 | 189 | 11657419 |
| 21 | R | 1.0 | 50 | 69 | 12 | 19 | 0.51 | 0.011 | 526 | 995 | 23.0 | 0.215 | 73 | 22885 | 214 | 9112176 |

[1)]Cold rolling ratio: Total draft of cold rolling;
[2)]$N_R$: Number density of retained austenite grain having grain size of 1.2 μm or larger;
[3)]El: Total elongation converted so as to correspond to 1.2-mm thickness,
λ: Bore expanding ratio,
n value: work hardening index All of cold-rolled steel sheets produced pursuant to the method defined in the present invention had the value of TS×El being 16,000 MPa % or higher, the value of TS×n value being 155 or higher, and the value of TS$^{1.7}$×λ being 5,000,000 MPa$^{1.7}$% or higher, exhibiting excellent ductility, work hardening property, and stretch flanging property. All of the example in which the average grain size of bcc grains surrounded by a grain boundary having an orientation difference of 15° or larger was 4.0 μm or smaller, the average number density of iron carbides was 8.0×10$^{-1}$/μm$^2$ or higher, and the cooling stop temperature after annealing was 340° C. or higher in the metallic structure of hot-rolled steel sheet had the value of TS×El being 19,000 MPa % or higher, the value of TS×n value being 160 or higher, and the value of TS$^{1.7}$×λ being 5,500,000 MPa$^{1.7}$% or higher, exhibiting especially excellent ductility, work hardening property, and stretch flanging property.

Example 3

Example 3 describes an example of the case where the coiling temperature in the hot-rolling process using the immediate rapid cooling method is higher than 400° C.

By using an experimental vacuum melting furnace, steels each having the chemical composition given in Table 7 were melted and cast. These ingots were formed into 30-mm thick billets by hot forging. The billets were heated to 1200° C. by using an electric heating furnace and held for 60 minutes, and thereafter were hot-rolled under the conditions given in Table 8.

Specifically, by using an experimental hot-rolling mill, 6-pass rolling was performed in the temperature region of $Ar_3$ point or higher to finish each of the billets into a steel sheet having a thickness of 2 to 3 mm. The draft of the final one pass was set at 12 to 42% in thickness decrease percentage. After hot rolling, the steel sheet was cooled to a temperature of 650 to 730° C. under various cooling conditions by using a water spray. Successively, after having been allowed to cool for 5 to 10 seconds, the steel sheet was cooled to various temperatures at a cooling rate of 60° C./s, and these temperatures were taken as coiling temperatures. The steel sheet was charged into an electric heating furnace that was held at that temperature, and was held for 30 minutes. Thereafter, the gradual cooling after coiling was simulated by furnace-cooling the steel sheet to room temperature at a cooling rate of 20° C./h, whereby a hot-rolled steel sheet was obtained.

The average grain size of bcc grains of the obtained hot-rolled steel sheet was measured by the method described in Example 1.

Next, the obtained hot-rolled steel sheet was pickled to form a base metal for cold rolling. The base metal was cold-rolled at a cold rolling ratio of 50 to 69%, whereby a cold-rolled steel sheet having a thickness of 0.8 to 1.2 mm was obtained. By using a continuous annealing simulator, the obtained cold-rolled steel sheet was heated to 550° C. at a heating rate of 10° C./s, thereafter being heated to various temperatures given in Table 8 at heating rate of 2° C./s, and was soaked for 95 seconds. Subsequently, the steel sheet was subjected to primary cooling to various temperatures given in Table 8, and further was subjected to secondary cooling from the primary cooling temperature to various temperatures given in Table 8 with the average cooling rate being 60° C./s, being held at that temperature for 330 seconds, and thereafter was cooled to room temperature, whereby an annealed steel sheet was obtained.

TABLE 7

| | Chemical composition (mass %) (remainder: Fe and impurities) | | | | | | | | $Ac_3$ point | $Ar_3$ point |
|---|---|---|---|---|---|---|---|---|---|---|
| Steel | C | Si | Mn | P | S | sol.A1 | N | Others | (° C.) | (° C.) |
| A | 0.124 | 0.05* | 2.97 | 0.011 | 0.003 | 0.031 | 0.0041 | | 792 | 698 |
| B | 0.145 | 0.99 | 2.49 | 0.012 | 0.004 | 0.029 | 0.0048 | | 836 | 742 |
| C | 0.147 | 0.98 | 2.48 | 0.011 | 0.003 | 0.030 | 0.0038 | Nb: 0.011 | 840 | 753 |
| D | 0.145 | 1.25 | 2.49 | 0.010 | 0.001 | 0.049 | 0.0030 | | 846 | 742 |
| E | 0.149 | 1.49 | 2.48 | 0.010 | 0.001 | 0.050 | 0.0035 | | 862 | 752 |
| F | 0.146 | 1.25 | 2.48 | 0.009 | 0.001 | 0.150 | 0.0032 | Nb: 0.010 | 874 | 764 |
| G | 0.166 | 1.51 | 2.53 | 0.010 | 0.001 | 0.048 | 0.0032 | Nb: 0.011 | 856 | 741 |

TABLE 7-continued

| Steel | Chemical composition (mass %) (remainder: Fe and impurities) C | Si | Mn | P | S | sol.A1 | N | Others | $Ac_3$ point (° C.) | $Ar_3$ point (° C.) |
|---|---|---|---|---|---|---|---|---|---|---|
| H | 0.174 | 1.26 | 2.50 | 0.008 | 0.001 | 0.050 | 0.0032 | Nb: 0.013 | 839 | 742 |
| I | 0.176 | 1.26 | 2.51 | 0.008 | 0.001 | 0.051 | 0.0031 | Nb: 0.011 | 843 | 736 |
| J | 0.175 | 1.25 | 2.50 | 0.008 | 0.001 | 0.050 | 0.0033 | Ti: 0.021 | 848 | 750 |
| K | 0.175 | 1.30 | 2.53 | 0.008 | 0.001 | 0.045 | 0.0030 | Nb: 0.010 | 849 | 731 |
| L | 0.184 | 1.28 | 2.24 | 0.009 | 0.001 | 0.050 | 0.0032 | Nb: 0.011 | 854 | 754 |
| M | 0.203 | 1.28 | 1.93 | 0.009 | 0.001 | 0.051 | 0.0027 | Nb: 0.011 | 855 | 768 |
| N | 0.197 | 1.26 | 1.92 | 0.009 | 0.001 | 0.140 | 0.0033 | Nb: 0.010 | 870 | 781 |
| O | 0.198 | 1.26 | 2.22 | 0.009 | 0.001 | 0.143 | 0.0031 | Nb: 0.011 | 855 | 758 |
| P | 0.197 | 1.28 | 2.24 | 0.009 | 0.001 | 0.151 | 0.0029 | Nb: 0.011 Cr: 0.30 | 848 | 786 |
| Q | 0.150 | 1.51 | 2.51 | 0.008 | 0.001 | 0.052 | 0.0034 | V: 0.11 REM: 0.0006 | 872 | 783 |
| R | 0.151 | 1.50 | 2.52 | 0.009 | 0.001 | 0.047 | 0.0031 | Bi: 0.008 | 862 | 772 |
| S | 0.149 | 1.25 | 2.47 | 0.009 | 0.001 | 0.152 | 0.0033 | Ca: 0.0009 Mg: 0.0007 | 864 | 775 |
| T | 0.148 | 1.26 | 2.48 | 0.009 | 0.001 | 0.141 | 0.0030 | Mo: 0.10 B: 0.0015 | 877 | 741 |
| U | 0.151 | 1.52 | 2.81 | 0.010 | 0.001 | 0.045 | 0.0030 | Nb: 0.011 | 848 | 735 |
| V | 0.173 | 1.21 | 2.47 | 0.006 | 0.001 | 0.047 | 0.0043 | Nb: 0.009 | 843 | 741 |
| W | 0.177 | 1.35 | 2.55 | 0.008 | 0.001 | 0.056 | 0.0032 | Nb: 0.010 | 849 | 728 |
| X | 0.178 | 1.26 | 2.56 | 0.008 | 0.001 | 0.040 | 0.0035 | Nb: 0.009 | 848 | 731 |

Note)

1. $Ac_3$ point was determined from thermal expansion change at the time when cold-rolled steel sheet was heated at 2° C./s.

2. $Ar_3$ point was determined from thermal expansion change at the time when cold-rolled steel sheet was heated to 900° C. and thereafter was cooled at 0.01° C./s.

TABLE 8

| Test No. | Steel | Hot-rolling condition: Final pass draft (%) | Sheet thickness after rolling[1)] (mm) | Rolling finishing temperature (° C.) | Rapid cooling stop temperature (° C.) | Time up to rapid cooling stop[2)] (s) | Average cooling rate[3)] (° C./s) | Coiling temperature (° C.) | Average grain size of bcc grains of hot-rolled steel sheet (μm) | Annealing condition: Soaking temperature (° C.) | Primary cooling rate (° C.) | Primary cooling stop temperature (° C.) | Secondary cooling stop temperature (° C.) |
|---|---|---|---|---|---|---|---|---|---|---|---|---|---|
| 1 | A* | 22 | 2.0 | 830 | 650 | 0.17 | 1200 | 600 | 6.3 | 850 | 1.7 | 700 | 400 |
| 2 | B | 25 | 3.0 | 830 | 680 | 4.14* | 61 | 600 | 7.8 | 820 | 2.0 | 700 | 350 |
| 3 | B | 25 | 3.0 | 840 | 710 | 0.20 | 722 | 600 | 5.1 | 790* | 2.0 | 700 | 350 |
| 4 | C | 25 | 3.0 | 830 | 670 | 4.14* | 65 | 600 | 7.3 | 820 | 2.0 | 700 | 350 |
| 5 | D | 42 | 2.0 | 900 | 660 | 0.18 | 1500 | 520 | 2.7 | 850 | 1.7 | 700 | 375 |
| 6 | D | 42 | 2.0 | 900 | 660 | 0.18 | 1500 | 560 | 3.0 | 850 | 0.4 | 810 | 375 |
| 7 | E | 33 | 2.0 | 900 | 660 | 0.17 | 1600 | 600 | 3.5 | 850 | 1.7 | 700 | 350 |
| 8 | E | 42 | 2.0 | 900 | 660 | 0.18 | 1500 | 560 | 2.8 | 850 | 1.7 | 700 | 350 |
| 9 | F | 33 | 2.0 | 900 | 660 | 0.17 | 1600 | 520 | 3.3 | 850 | 1.7 | 700 | 375 |
| 10 | G | 33 | 2.0 | 900 | 650 | 0.17 | 1667 | 540 | 3.4 | 865 | 1.8 | 700 | 350 |
| 11 | H | 22 | 2.0 | 900 | 720 | 5.52* | 51 | 600 | 6.8 | 850 | 1.7 | 700 | 350 |
| 12 | I | 42 | 2.0 | 900 | 660 | 0.18 | 1500 | 560 | 2.7 | 850 | 1.7 | 700 | 425 |
| 13 | I | 33 | 2.0 | 900 | 660 | 0.17 | 1600 | 600 | 3.7 | 900 | 2.2 | 700 | 425 |
| 14 | J | 42 | 2.0 | 900 | 660 | 0.18 | 1500 | 560 | 2.6 | 850 | 1.7 | 700 | 400 |
| 15 | J | 33 | 2.0 | 900 | 660 | 0.17 | 1600 | 600 | 3.8 | 900 | 2.2 | 700 | 400 |
| 16 | K | 12* | 2.0 | 900 | 660 | 0.15 | 1846 | 560 | 6.3 | 850 | 1.7 | 700 | 375 |
| 17 | K | 22 | 2.0 | 900 | 660 | 0.17 | 1600 | 560 | 4.8 | 850 | 1.7 | 700 | 375 |
| 18 | K | 33 | 2.0 | 900 | 660 | 0.17 | 1600 | 600 | 3.7 | 790* | 1.0 | 700 | 400 |
| 19 | K | 33 | 2.0 | 900 | 660 | 0.17 | 1600 | 560 | 3.3 | 850 | 1.7 | 700 | 325 |
| 20 | K | 42 | 2.0 | 900 | 660 | 0.17 | 1600 | 560 | 2.7 | 910 | 6.0 | 790 | 425 |
| 21 | L | 33 | 2.0 | 900 | 660 | 0.17 | 1600 | 600 | 3.5 | 850 | 1.7 | 700 | 400 |
| 22 | L | 42 | 2.0 | 900 | 660 | 0.18 | 1500 | 560 | 2.6 | 850 | 1.7 | 700 | 400 |
| 23 | L | 33 | 2.0 | 900 | 660 | 0.17 | 1600 | 600 | 3.5 | 910 | 2.3 | 700 | 400 |
| 24 | M | 33 | 2.0 | 900 | 670 | 0.17 | 1533 | 600 | 3.3 | 850 | 1.7 | 700 | 350 |
| 25 | M | 42 | 2.0 | 900 | 660 | 0.18 | 1500 | 560 | 2.7 | 850 | 1.7 | 700 | 400 |
| 26 | M | 33 | 2.0 | 900 | 670 | 0.17 | 1533 | 560 | 2.9 | 910 | 2.3 | 700 | 350 |
| 27 | N | 33 | 2.0 | 900 | 660 | 0.18 | 1500 | 510 | 3.4 | 850 | 1.7 | 700 | 400 |
| 28 | O | 33 | 2.0 | 900 | 670 | 0.17 | 1533 | 520 | 3.5 | 850 | 1.7 | 700 | 400 |
| 29 | P | 33 | 2.0 | 900 | 660 | 0.18 | 1500 | 510 | 3.2 | 850 | 1.7 | 700 | 350 |
| 30 | P | 42 | 2.0 | 900 | 660 | 0.18 | 1500 | 560 | 2.9 | 850 | 0.3 | 820 | 350 |
| 31 | Q | 42 | 2.0 | 900 | 650 | 0.18 | 1563 | 560 | 2.7 | 865 | 1.8 | 700 | 350 |
| 32 | R | 42 | 2.0 | 900 | 650 | 0.18 | 1563 | 560 | 2.7 | 865 | 1.8 | 700 | 350 |
| 33 | S | 42 | 2.0 | 900 | 660 | 0.18 | 1500 | 560 | 2.9 | 865 | 1.8 | 700 | 400 |
| 34 | T | 42 | 2.0 | 900 | 660 | 0.18 | 1500 | 560 | 2.8 | 865 | 1.8 | 700 | 400 |
| 35 | U | 22 | 2.0 | 900 | 660 | 0.17 | 1600 | 600 | 5.5 | 850 | 6.0 | 810 | 350 |
| 36 | V | 24 | 2.6 | 905 | 660 | 0.17 | 1633 | 505 | 3.9 | 850 | 1.7 | 700 | 425 |
| 37 | W | 29 | 2.6 | 920 | 695 | 0.17 | 1500 | 505 | 3.8 | 850 | 1.7 | 700 | 400 |
| 38 | X | 36 | 2.6 | 900 | 655 | 0.17 | 1633 | 585 | 3.8 | 850 | 2.0 | 670 | 400 |
| 39 | X | 32 | 2.6 | 910 | 680 | 0.17 | 1533 | 560 | 3.7 | 840 | 1.6 | 700 | 400 |

TABLE 8-continued

| Test No. | Steel | Hot-rolling condition: Final pass draft (%) | Sheet thickness after rolling[1)] (mm) | Rolling finishing temperature (° C.) | Rapid cooling stop temperature (° C.) | Time up to rapid cooling stop[2)] (s) | Average cooling rate[3)] (° C./s) | Coiling temperature (° C.) | Average grain size of bcc grains of hot-rolled steel sheet (μm) | Annealing condition: Soaking temperature (° C.) | Primary cooling rate (° C.) | Primary cooling stop temperature (° C.) | Secondary cooling stop temperature (° C.) |
|---|---|---|---|---|---|---|---|---|---|---|---|---|---|
| 40 | X | 33 | 2.6 | 900 | 655 | 0.17 | 1633 | 510 | 3.4 | 850 | 1.7 | 700 | 425 |
| 41 | X | 32 | 2.6 | 945 | 730 | 0.17 | 1433 | 560 | 3.9 | 850 | 1.7 | 700 | 400 |

[1)]Sheet thickness of hot rolled steel sheet.
[2)]Time from rolling completion to rapid cooling stop.
[3)]Average cooling rate during rapid cooling.

For the obtained annealed steel sheet, the volume fractions of low-temperature transformation producing phase, retained austenite, and polygonal ferrite, the average grain sizes of retained austenite and polygonal ferrite, the number density ($N_R$) per unit area of retained austenite grains each having a grain size of 1.2 μm or larger, the yield stress (YS), the tensile strength (TS), the total elongation (El), the work hardening index (n value), and the bore expanding ratio (λ) were measured as described in Example 1. Table 9 gives the metallic structure observation results and the performance evaluation results of the cold-rolled steel sheet after being annealed. In Tables 7 to 9, mark "*" attached to a symbol or numeral indicates that the symbol or numeral is out of the range of the present invention.

TABLE 9

| Test No. | Steel | Cold-rolled steel sheet thickness (mm) | Cold rolling ratio[1)] (%) | Metallic structure of cold-rolled steel sheet (%: volume ratio): Low-temperature transformation producing phase (%) | Retained γ (%) | Polygonal α (%) | Average grain size (μm): Retained γ | Average grain size (μm): Polygonal α | $N_R$[2)] (number/μm²) | Mechanical property of cold-rolled steel sheet[3)]: YS (MPa) | TS (MPa) | El (%) | n value | λ (%) | TS × El (MPa %) | TS × n value (MPa) | TS$^{1.7}$ × λ (MPa$^{1.7}$ %) |
|---|---|---|---|---|---|---|---|---|---|---|---|---|---|---|---|---|---|
| 1 | A* | 1.0 | 50 | 78 | 4.0 | 18 | 0.81 | 6.4 | 0.005 | 502 | 716 | 24.8 | 0.175 | 47 | 17757 | 125 | 3353127 |
| 2 | B | 1.2 | 60 | 64 | 10 | 26 | 0.82 | 6.8 | 0.037 | 503 | 978 | 17.1 | 0.148 | 35 | 16724 | 145 | 4242717 |
| 3 | B | 1.2 | 60 | 39. | 8 | 53* | 0.83 | 4.8 | 0.039 | 520 | 1056 | 15.5 | 0.159 | 32 | 16368 | 168 | 4419556 |
| 4 | C | 1.2 | 60 | 64 | 8 | 28 | 0.71 | 73 | 0.036 | 511 | 1020 | 16.0 | 0.143 | 33 | 16320 | 146 | 4296692 |
| 5 | D | 1.0 | 50 | 86 | 7 | 7 | 0.42 | 1.4 | 0.006 | 521 | 952 | 22.1 | 0.202 | 83 | 21039 | 192 | 9610830 |
| 6 | D | 1.0 | 50 | 92 | 7 | 1.0 | 0.46 | 0.6 | 0.008 | 638 | 980 | 19.5 | 0.164 | 88 | 19110 | 161 | 10704515 |
| 7 | E | 1.0 | 50 | 80 | 8 | 12 | 0.44 | 2.5 | 0.007 | 512 | 963 | 22.3 | 0.200 | 57 | 21475 | 193 | 6730379 |
| 8 | E | 1.0 | 50 | 78 | 8 | 14 | 0.43 | 3.2 | 0.006 | 519 | 964 | 22.1 | 0.189 | 74 | 21304 | 182 | 8753116 |
| 9 | F | 1.0 | 50 | 73 | 10 | 17 | 0.55 | 3.2 | 0.018 | 606 | 1003 | 21.5 | 0.167 | 57 | 21565 | 168 | 7212510 |
| 10 | G | 1.0 | 50 | 83 | 8 | 9 | 0.52 | 1.6 | 0.015 | 633 | 1095 | 18.9 | 0.161 | 66 | 20696 | 176 | 9695003 |
| 11 | H | 1.0 | 50 | 90 | 8 | 2.0 | 0.74 | 0.6 | 0.036 | 760 | 1084 | 17.3 | 0.136 | 29 | 18753 | 147 | 4187432 |
| 12 | I | 1.0 | 50 | 80 | 15 | 5 | 0.50 | 0.8 | 0.014 | 685 | 1034 | 23.4 | 0.186 | 48 | 24196 | 192 | 6396261 |
| 13 | I | 1.0 | 50 | 85 | 13 | 2.0 | 0.62 | 0.8 | 0.027 | 696 | 1039 | 18.7 | 0.157 | 57 | 19429 | 163 | 7658104 |
| 14 | J | 1.0 | 50 | 80 | 14 | 6 | 0.51 | 1.0 | 0.013 | 670 | 1023 | 22.9 | 0.190 | 49 | 23427 | 194 | 6411869 |
| 15 | J | 1.0 | 50 | 85 | 13 | 2.0 | 0.64 | 1.1 | 0.028 | 715 | 1045 | 18.4 | 0.154 | 58 | 19228 | 161 | 7869111 |
| 16 | K | 1.0 | 50 | 90 | 8 | 2.0 | 0.71 | 0.9 | 0.036 | 736 | 1040 | 18.2 | 0.143 | 30 | 18928 | 149 | 4037178 |
| 17 | K | 1.0 | 50 | 86 | 9 | 5 | 0.64 | 1.2 | 0.032 | 732 | 1047 | 18.7 | 0.146 | 35 | 19579 | 153 | 4764062 |
| 18 | K | 1.0 | 50 | 42* | 13 | 45* | 0.82 | 4.9 | 0.040 | 642 | 990 | 20.5 | 0.196 | 27 | 20295 | 194 | 3341516 |
| 19 | K | 1.0 | 50 | 85 | 8 | 7 | 0.59 | 2.0 | 0.031 | 762 | 1094 | 16.2 | 0.143 | 35 | 17723 | 156 | 5133310 |
| 20 | K | 1.0 | 50 | 88 | 12 | 0.0 | 0.62 | — | 0.028 | 792 | 1099 | 17.3 | 0.147 | 62 | 19013 | 162 | 9164057 |
| 21 | L | 1.0 | 50 | 78 | 12 | 10 | 0.51 | 2.2 | 0.013 | 501 | 930 | 23.5 | 0.243 | 55 | 21855 | 226 | 6120455 |
| 22 | L | 1.0 | 50 | 77 | 13 | 10 | 0.51 | 2.0 | 0.014 | 457 | 937 | 22.3 | 0.243 | 54 | 20895 | 228 | 6086268 |
| 23 | L | 1.0 | 50 | 80 | 11 | 9 | 0.63 | 5.1 | 0.022 | 640 | 953 | 20.0 | 0.172 | 62 | 19060 | 164 | 7191999 |
| 24 | M | 1.0 | 50 | 65 | 10 | 25 | 0.54 | 4.7 | 0.018 | 569 | 985 | 22.6 | 0.172 | 52 | 22261 | 169 | 6380356 |
| 25 | M | 1.0 | 50 | 61 | 13 | 26 | 0.62 | 4.8 | 0.025 | 575 | 901 | 26.4 | 0.184 | 59 | 23786 | 166 | 6221343 |
| 26 | M | 1.0 | 50 | 71 | 8 | 21 | 0.55 | 6.3 | 0.020 | 659 | 998 | 19.2 | 0.162 | 48 | 19162 | 162 | 6022311 |
| 27 | N | 1.0 | 50 | 61 | 14 | 25 | 0.65 | 4.5 | 0.028 | 527 | 879 | 27.1 | 0.193 | 64 | 23821 | 170 | 6470846 |
| 28 | O | 1.0 | 50 | 74 | 12 | 14 | 0.55 | 2.3 | 0.021 | 693 | 993 | 22.2 | 0.169 | 53 | 22045 | 168 | 6593099 |
| 29 | P | 1.0 | 50 | 85 | 11 | 4 | 0.43 | 0.7 | 0.008 | 571 | 1071 | 19.3 | 0.187 | 49 | 20670 | 200 | 6931675 |
| 30 | P | 1.0 | 50 | 88 | 10 | 2.0 | 0.44 | 0.5 | 0.008 | 693 | 1082 | 17.7 | 0.149 | 58 | 19151 | 161 | 8348613 |
| 31 | Q | 1.0 | 50 | 77 | 8 | 15 | 0.42 | 2.9 | 0.006 | 587 | 1011 | 21.5 | 0.192 | 77 | 21737 | 194 | 9875695 |
| 32 | R | 1.0 | 50 | 77 | 9 | 14 | 0.41 | 2.8 | 0.007 | 535 | 986 | 21.6 | 0.199 | 72 | 21298 | 196 | 8849592 |
| 33 | S | 1.0 | 50 | 84 | 9 | 7 | 0.43 | 1.4 | 0.007 | 699 | 1061 | 20.3 | 0.177 | 86 | 21538 | 188 | 11973320 |
| 34 | T | 1.0 | 50 | 73 | 10 | 17 | 0.47 | 2.5 | 0.010 | 534 | 999 | 22.8 | 0.212 | 75 | 22777 | 212 | 9425895 |
| 35 | U | 1.0 | 50 | 91 | 9 | 0.0 | 0.60 | — | 0.031 | 675 | 1179 | 14.6 | 0.132 | 56 | 17213 | 156 | 9327419 |
| 36 | V | 1.0 | 62 | 82 | 14 | 4 | 0.58 | 0.7 | 0.024 | 584 | 1012 | 20.2 | 0.164 | 51 | 20442 | 166 | 6552048 |

TABLE 9-continued

| | | | | Metallic structure of cold-rolled steel sheet (%: volume ratio) | | | | | | Mechanical property of cold-rolled steel sheet[3)] | | | | | | | |
|---|---|---|---|---|---|---|---|---|---|---|---|---|---|---|---|---|---|
| Test No. | Steel | Cold-rolled steel sheet thickness (mm) | Cold rolling ratio[1)] (%) | Low-temperature transformation producing phase (%) | Retained γ (%) | Polygonal α (%) | Average grain size (μm) Retained γ | Average grain size (μm) Polygonal α | $N_R$[2)] (number/μm²) | YS (MPa) | TS (MPa) | El (%) | n value | λ (%) | TS × El (MPa %) | TS × n value (MPa) | TS$^{1.7}$ × λ (MPa$^{1.7}$ %) |
| 37 | W | 0.8 | 69 | 81 | 14 | 5 | 0.54 | 0.7 | 0.019 | 608 | 1077 | 20.0 | 0.162 | 57 | 21540 | 174 | 8140321 |
| 38 | X | 0.8 | 69 | 81 | 13 | 6 | 0.52 | 1.0 | 0.017 | 671 | 1166 | 19.2 | 0.153 | 49 | 22387 | 178 | 8009098 |
| 39 | X | 1.2 | 54 | 78 | 13 | 9 | 0.58 | 1.8 | 0.025 | 645 | 1112 | 18.8 | 0.149 | 59 | 20906 | 166 | 8896725 |
| 40 | X | 0.8 | 69 | 79 | 16 | 5 | 0.55 | 0.8 | 0.019 | 611 | 1091 | 19.1 | 0.166 | 47 | 20838 | 181 | 6861198 |
| 41 | X | 1.2 | 54 | 83 | 13 | 4 | 0.58 | 0.8 | 0.023 | 617 | 1084 | 19.0 | 0.159 | 48 | 20596 | 172 | 6930922 |

[1)]Cold rolling ratio: Total draft of cold rolling;
[2)]Ne: Number density of retained austenite grain having grain size of 1.2 pm or larger;
[3)]El: Total elongation converted so as to correspond to 1.2-mm thickness,
λ: Bore expanding ratio,
n value: work hardening index All of cold-rolled steel sheets produced pursuant to the method defined in the present invention had the value of TS×El being 15,000 MPa % or higher, the value of TS×n value being 150 or higher, and the value of TS$^{1.7}$×λ being 4,500,000 MPa$^{1.7}$% or higher, exhibiting excellent ductility, work hardening property, and stretch flanging property. All of the example in which the roll draft of the final one pass of hot rolling was higher than 25%, and the secondary cooling stop temperature after annealing was 340° C. or higher had the value of TS×El being 19,000 MPa % or higher, the value of TS×n value being 160 or higher, and the value of TS$^{1.7}$×λ being 5,500,000 MPa$^{1.7}$% or higher, exhibiting further excellent ductility, work hardening property, and stretch flanging property. All of the example in which the roll draft of the final one pass of hot rolling was higher than 25%, the soaking treatment temperature in annealing was ($Ac_3$ point−40° C.) or higher and lower than ($Ac_3$ point+50° C.), after soaking treatment, the steel sheet was cooled by 50° C. or more from the soaking temperature at a cooling rate of lower than 10.0° C./s, and the secondary cooling stop temperature was 340° C. or higher had the value of TS×El being 20,000 MPa % or higher, the value of TS×n value being 165 or higher, and the value of TS$^{1.7}$×λ being 6,000,000 MPa$^{1.7}$% or higher, exhibiting still further excellent ductility, work hardening property, and stretch flanging property.

Example 4

Example 4 describes an example of the case where a hot-rolled steel sheet obtained by setting the coiling temperature at 400° C. or lower in the hot-rolling process using the immediate rapid cooling method is subjected to hot-rolled sheet annealing.

By using an experimental vacuum melting furnace, steels each having the chemical composition given in Table 10 were melted and cast. These ingots were formed into 30-mm thick billets by hot forging. The billets were heated to 1200° C. by using an electric heating furnace and held for 60 minutes, and thereafter were hot-rolled under the conditions given in Table 11.

Specifically, by using an experimental hot-rolling mill, 6-pass rolling was performed in the temperature region of $Ar_3$ point or higher to finish each of the billets into a steel sheet having a thickness of 2 to 3 mm. The draft of the final one pass was set at 22 to 42% in thickness decrease percentage. After hot rolling, the steel sheet was cooled to a temperature of 650 to 720° C. under various cooling conditions by using a water spray. Successively, after having been allowed to cool for 5 to 10 seconds, the steel sheet was cooled to various temperatures at a cooling rate of 60° C./s, and these temperatures were taken as coiling temperatures. The steel sheet was charged into an electric heating furnace that was held at that temperature, and was held for 30 minutes. Thereafter, the gradual cooling after coiling was simulated by furnace-cooling the steel sheet to room temperature at a cooling rate of 20° C./h, whereby a hot-rolled steel sheet was obtained.

The obtained hot-rolled steel sheet was heated to various heating temperatures given in Table 11 at a heating rate of 50° C./h. After being held for various periods of time or without being held, the steel sheet was cooled to room temperature at a cooling rate of 20° C./h, whereby a hot-rolled and annealed steel sheet was obtained.

The average grain size of bcc grains of the obtained hot-rolled and annealed steel sheet was measured by the method described in Example 1. Also, the average number density of iron carbides of the hot-rolled and annealed steel sheet was determined by the method using the aforementioned SEM and Auger electron spectroscope.

Next, the obtained hot-rolled and annealed steel sheet was pickled to form a base metal for cold rolling. The base metal was cold-rolled at a cold rolling ratio of 50 to 69%, whereby a cold-rolled steel sheet having a thickness of 0.8 to 1.2 mm was obtained. By using a continuous annealing simulator, the obtained cold-rolled steel sheet was heated to 550° C. at a heating rate of 10° C./s, thereafter being heated to various temperatures given in Table 11 at heating rate of 2° C./s, and was soaked for 95 seconds. Subsequently, the steel sheet was subjected to primary cooling to various temperatures given in Table 11, and further was subjected to secondary cooling from the primary cooling temperature to various temperatures given in Table 11 with the average cooling rate being 60° C./s, being held at that temperature for 330 seconds, and thereafter was cooled to room temperature, whereby an annealed steel sheet was obtained.

TABLE 10

| | Chemical composition (mass %) (remainder: Fe and impurities) | | | | | | | | $Ac_3$ point | $Ar_3$ point |
|---|---|---|---|---|---|---|---|---|---|---|
| Steel | C | Si | Mn | P | S | sol.A1 | N | Others | (° C.) | (° C.) |
| A | 0.124 | 0.05* | 2.97 | 0.011 | 0.003 | 0.031 | 0.0041 | | 792 | 698 |
| B | 0.145 | 0.99 | 2.49 | 0.012 | 0.004 | 0.029 | 0.0048 | | 836 | 742 |
| C | 0.143 | 1.23 | 2.50 | 0.009 | 0.001 | 0.052 | 0.0028 | Nb: 0.011 | 849 | 756 |
| D | 0.138 | 1.49 | 2.50 | 0.009 | 0.001 | 0.053 | 0.0026 | Nb: 0.011 | 872 | 757 |
| E | 0.149 | 1.49 | 2.48 | 0.010 | 0.001 | 0.050 | 0.0035 | | 862 | 752 |
| F | 0.146 | 1.23 | 2.45 | 0.009 | 0.001 | 0.140 | 0.0031 | | 861 | 770 |
| G | 0.151 | 1.52 | 2.81 | 0.010 | 0.001 | 0.045 | 0.0030 | Nb: 0.011 | 849 | 760 |
| H | 0.166 | 1.51 | 2.53 | 0.010 | 0.001 | 0.048 | 0.0032 | Nb: 0.011 | 856 | 741 |
| I | 0.174 | 1.26 | 2.50 | 0.008 | 0.001 | 0.050 | 0.0032 | Nb: 0.013 | 839 | 742 |
| J | 0.176 | 1.26 | 2.51 | 0.008 | 0.001 | 0.051 | 0.0031 | Nb: 0.011 | 843 | 736 |
| K | 0.175 | 1.25 | 2.50 | 0.008 | 0.001 | 0.050 | 0.0033 | Ti: 0.021 | 848 | 750 |
| L | 0.203 | 1.28 | 1.93 | 0.009 | 0.001 | 0.051 | 0.0027 | Nb: 0.011 | 855 | 768 |
| M | 0.197 | 1.26 | 1.92 | 0.009 | 0.001 | 0.140 | 0.0033 | Nb: 0.010 | 870 | 781 |
| N | 0.197 | 1.28 | 2.24 | 0.009 | 0.001 | 0.151 | 0.0029 | Nb: 0.011 Cr: 0.30 | 848 | 786 |
| O | 0.150 | 1.51 | 2.51 | 0.008 | 0.001 | 0.052 | 0.0034 | V: 0.11 REM: 0.0006 | 872 | 783 |
| P | 0.151 | 1.50 | 2.52 | 0.009 | 0.001 | 0.047 | 0.0031 | Bi: 0.008 | 862 | 772 |
| Q | 0.149 | 1.25 | 2.47 | 0.009 | 0.001 | 0.152 | 0.0033 | Ca: 0.0009 Mg: 0.0007 | 864 | 775 |
| R | 0.148 | 1.26 | 2.48 | 0.009 | 0.001 | 0.141 | 0.0030 | Mo: 0.10 B: 0.0015 | 877 | 741 |
| S | 0.151 | 1.52 | 2.81 | 0.010 | 0.001 | 0.045 | 0.0030 | Nb: 0.010 | 848 | 735 |
| T | 0.178 | 1.26 | 2.56 | 0.008 | 0.001 | 0.040 | 0.0035 | Nb: 0.009 | 848 | 731 |

Note)

1. $Ac_3$ point was determined from thermal expansion change at the time when cold-rolled steel sheet was heated at 2° C./s.
2. $Ar_3$ point was determined from thermal expansion change at the time when cold-rolled steel sheet was heated to 900° C. and thereafter was cooled at 0.01° C./s.

TABLE 11

| | | Hot-rolling condition | | | | | | | Hot-rolled sheet annealing | | Hot-rolled and annealed steel sheet | | Annealing condition | | | |
|---|---|---|---|---|---|---|---|---|---|---|---|---|---|---|---|---|
| Test No. | Steel | Final pass draft (%) | Sheet thickness after rolling[1)] (mm) | Rolling finishing temperature (° C.) | Rapid cooling stop temperature (° C.) | Time up to rapid cooling stop[2)] (s) | Average cooling rate[3)] (° C./s) | Coiling temperature[4)] (° C.) | Heating temperature (° C.) | Holding time[5)] (h) | Average grain size of bcc grains (μm) | Average number density of iron carbides (number/μm²) | Soaking temperature (° C.) | Primary cooling rate (° C./s) | Primary cooling stop temperature (° C.) | Secondary cooling stop temperature (° C.) |
| 1 | A* | 22 | 2.0 | 830 | 650 | 0.17 | 1200 | 300 | 600 | 2 | 6.2 | $4.2 \times 10^{-1}$ | 850 | 1.7 | 700 | 400 |
| 2 | B | 25 | 3.0 | 830 | 680 | 4.14* | 61 | 200 | 600 | 1 | 7.3 | $<1.0 \times 10^{-1}$ | 820 | 2.0 | 700 | 350 |
| 3 | B | 25 | 3.0 | 840 | 710 | 0.20 | 722 | 200 | 600 | 1 | 5.6 | $6.8 \times 10^{-1}$ | 790* | 2.0 | 700 | 350 |
| 4 | C | 22 | 2.0 | 900 | 650 | 0.17 | 1667 | RT | 620 | 0 | 4.8 | $7.1 \times 10^{-1}$ | 850 | 1.7 | 700 | 325 |
| 5 | D | 33 | 2.0 | 900 | 660 | 0.17 | 1600 | RT | 620 | 0 | 3.3 | $8.5 \times 10^{-1}$ | 850 | 1.7 | 700 | 350 |
| 6 | E | 33 | 2.0 | 900 | 660 | 0.17 | 1600 | RT | 620 | 0 | 3.5 | $8.3 \times 10^{-1}$ | 850 | 1.7 | 700 | 350 |
| 7 | F | 33 | 2.0 | 900 | 660 | 0.17 | 1600 | RT | 620 | 0 | 3.5 | $8.1 \times 10^{-1}$ | 850 | 1.7 | 700 | 375 |
| 8 | G | 33 | 2.0 | 900 | 660 | 0.17 | 1600 | RT | 620 | 0 | 3.2 | $8.9 \times 10^{-1}$ | 850 | 1.7 | 700 | 350 |
| 9 | H | 33 | 2.0 | 900 | 650 | 0.17 | 1667 | RT | 620 | 0 | 3.3 | $9.2 \times 10^{-1}$ | 850 | 1.7 | 700 | 350 |
| 10 | I | 22 | 2.0 | 900 | 720 | 5.52* | 51 | 200 | 500 | 2 | 7.8 | $<1.0 \times 10^{-1}$ | 850 | 1.7 | 700 | 350 |
| 11 | J | 33 | 2.0 | 900 | 660 | 0.18 | 1500 | RT | 620 | 0 | 3.4 | $9.8 \times 10^{-1}$ | 850 | 1.7 | 700 | 425 |
| 12 | J | 33 | 2.0 | 900 | 660 | 0.17 | 1600 | RT | 640 | 1 | 3.3 | 1.0 | 900 | 2.2 | 700 | 425 |
| 13 | I | 42 | 2.0 | 900 | 660 | 0.17 | 1600 | RT | 620 | 0 | 2.7 | 1.1 | 910 | 6.0 | 790 | 425 |
| 14 | K | 42 | 2.0 | 900 | 660 | 0.18 | 1500 | 150 | 640 | 1 | 2.8 | 1.1 | 850 | 1.7 | 700 | 400 |
| 15 | K | 33 | 2.0 | 900 | 660 | 0.17 | 1600 | RT | 640 | 1 | 3.2 | $9.9 \times 10^{-1}$ | 900 | 2.2 | 700 | 400 |
| 16 | L | 42 | 2.0 | 900 | 660 | 0.18 | 1500 | RT | 620 | 0 | 2.6 | 1.2 | 850 | 1.7 | 700 | 350 |
| 17 | L | 33 | 2.0 | 900 | 660 | 0.17 | 1600 | RT | 620 | 0 | 3.4 | 1.2 | 910 | 2.3 | 700 | 350 |
| 18 | M | 33 | 2.0 | 900 | 660 | 0.18 | 1500 | RT | 620 | 0 | 3.5 | 1.1 | 850 | 1.7 | 700 | 350 |
| 19 | N | 33 | 2.0 | 900 | 660 | 0.18 | 1500 | RT | 640 | 1 | 3.3 | 1.1 | 850 | 1.7 | 700 | 350 |
| 20 | N | 42 | 2.0 | 900 | 660 | 0.18 | 1500 | RT | 640 | 1 | 2.6 | 1.1 | 850 | 0.3 | 820 | 350 |
| 21 | O | 42 | 2.0 | 900 | 650 | 0.18 | 1563 | 100 | 640 | 1 | 2.7 | $9.3 \times 10^{-1}$ | 865 | 1.8 | 700 | 350 |
| 22 | P | 42 | 2.0 | 900 | 650 | 0.18 | 1563 | 100 | 640 | 1 | 2.6 | $9.1 \times 10^{-1}$ | 865 | 1.8 | 700 | 350 |
| 23 | Q | 42 | 2.0 | 900 | 660 | 0.18 | 1500 | 100 | 620 | 0 | 2.9 | $8.7 \times 10^{-1}$ | 865 | 1.8 | 700 | 400 |
| 24 | R | 42 | 2.0 | 900 | 660 | 0.18 | 1500 | RT | 620 | 0 | 2.7 | $8.8 \times 10^{-1}$ | 865 | 1.8 | 700 | 400 |
| 25 | S | 22 | 2.0 | 900 | 660 | 0.17 | 1600 | RT | 620 | 0 | 4.4 | $7.3 \times 10^{-1}$ | 850 | 6.0 | 810 | 350 |

TABLE 11-continued

| | | Hot-rolling condition | | | | | | | Hot-rolled and annealed steel sheet | | | | Annealing condition | | | |
|---|---|---|---|---|---|---|---|---|---|---|---|---|---|---|---|---|
| Test No. | Steel | Final pass draft (%) | Sheet thickness after rolling[1] (mm) | Rolling finishing temperature (° C.) | Rapid cooling stop temperature (° C.) | Time up to rapid cooling stop[2] (s) | Average cooling rate[3] (° C./s) | Coiling temperature[4] (° C.) | Hot-rolled sheet annealing: Heating temperature (° C.) | Hot-rolled sheet annealing: Holding time[5] (h) | Average grain size of bcc grains (μm) | Average number density of iron carbides (number/μm²) | Soaking temperature (° C.) | Primary cooling rate (° C./s) | Primary cooling stop temperature (° C.) | Secondary cooling stop temperature (° C.) |
| 26 | T | 29 | 2.6 | 910 | 680 | 0.17 | 1600 | RT | 620 | 0 | 3.7 | $8.8 \times 10^{-1}$ | 850 | 1.7 | 700 | 400 |
| 27 | T | 29 | 2.6 | 910 | 680 | 0.17 | 1600 | RT | 620 | 0 | 3.7 | $8.8 \times 10^{-1}$ | 850 | 1.7 | 700 | 400 |

[1]Sheet thickness of hot-rolled steel sheet
[2]Time from rolling completion to rapid cooling stop.
[3]Average cooling rate during rapid cooling.
[4]RT means room temperature.
[5]0 h means that holding was not performed.

For the obtained annealed steel sheet, the volume fractions of low-temperature transformation producing phase, retained austenite, and polygonal ferrite, the average grain sizes of retained austenite and polygonal ferrite, the number density ($N_R$) per unit area of retained austenite grains each having a grain size of 1.2 m or larger, the yield stress (YS), the tensile strength (TS), the total elongation (El), the work hardening index (n value), and the bore expanding ratio (λ) were measured as described in Example 1. Table 12 gives the metallic structure observation results and the performance evaluation results of the cold-rolled steel sheet after being annealed. In Tables 10 to 12, mark "*" attached to a symbol or numeral indicates that the symbol or numeral is out of the range of the present invention.

TABLE 12

| | | | | Metallic structure of cold-rolled steel sheet (%: volume ratio) | | | | | | Mechanical property of cold-rolled steel sheet[3] | | | | | | | |
|---|---|---|---|---|---|---|---|---|---|---|---|---|---|---|---|---|---|
| Test No. | Steel | Cold-rolled steel sheet thickness (mm) | Cold rolling ratio[1] (%) | Low-temperature transformation producing phase (%) | Retained austenite (%) | Polygonal α (%) | Average grain size (μm): Retained γ | Average grain size (μm): Polygonal α | $N_R$[2] (number/μm²) | YS (MPa) | TS (MPa) | El (%) | N value | λ (%) | TS × El (MPa %) | TS × n value (MPa) | $TS^{1.7}$ × λ ($MPa^{1.7}$ %) |
| 1 | A* | 1.0 | 50 | 76 | 3 | 21 | 0.83 | 6.0 | 0.006 | 496 | 705 | 24.0 | 0.172 | 48 | 16920 | 121 | 3335514 |
| 2 | B | 1.2 | 60 | 61 | 11 | 28 | 0.83 | 6.1 | 0.038 | 497 | 972 | 17.3 | 0.149 | 35 | 16816 | 145 | 4198563 |
| 3 | B | 1.2 | 60 | 35* | 10 | 55* | 0.81 | 4.2 | 0.038 | 515 | 1050 | 15.6 | 0.161 | 31 | 16380 | 169 | 4240172 |
| 4 | C | 1.0 | 50 | 84 | 7 | 9 | 0.78 | 1.9 | 0.033 | 676 | 981 | 16.5 | 0.162 | 57 | 16187 | 159 | 6945638 |
| 5 | D | 1.0 | 50 | 80 | 9 | 11 | 0.53 | 2.2 | 0.014 | 544 | 996 | 21.3 | 0.194 | 52 | 21215 | 193 | 6501959 |
| 6 | E | 1.0 | 50 | 82 | 7 | 11 | 0.42 | 2.1 | 0.008 | 538 | 988 | 20.7 | 0.178 | 53 | 20452 | 176 | 6536762 |
| 7 | F | 1.0 | 50 | 80 | 8 | 12 | 0.42 | 2.5 | 0.006 | 573 | 996 | 20.6 | 0.184 | 63 | 20518 | 183 | 7877373 |
| 8 | G | 1.0 | 50 | 86 | 10 | 4 | 0.59 | 0.5 | 0.018 | 619 | 1179 | 17.3 | 0.152 | 61 | 20397 | 179 | 10160224 |
| 9 | H | 1.0 | 50 | 82 | 9 | 9 | 0.51 | 1.7 | 0.011 | 565 | 1121 | 19.8 | 0.190 | 60 | 22196 | 213 | 9172354 |
| 10 | I | 1.0 | 50 | 89 | 9 | 2.0 | 0.72 | 0.4 | 0.036 | 759 | 1080 | 17.5 | 0.133 | 27 | 18900 | 144 | 3874219 |
| 11 | J | 1.0 | 50 | 81 | 15 | 4 | 0.55 | 0.6 | 0.017 | 727 | 1046 | 21.0 | 0.181 | 45 | 21966 | 189 | 6115280 |
| 12 | J | 1.0 | 50 | 85 | 14 | 1.0 | 0.65 | 0.5 | 0.028 | 691 | 1037 | 19.0 | 0.158 | 55 | 19703 | 164 | 7365234 |
| 13 | J | 1.0 | 50 | 85 | 15 | 0.0 | 0.61 | — | 0.026 | 700 | 1044 | 18.3 | 0.155 | 58 | 19105 | 162 | 7856314 |
| 14 | K | 1.0 | 50 | 77 | 16 | 7 | 0.53 | 0.7 | 0.015 | 662 | 1018 | 23.2 | 0.193 | 48 | 23618 | 196 | 6228916 |
| 15 | K | 1.0 | 50 | 83 | 15 | 2.0 | 0.62 | 0.8 | 0.027 | 702 | 1040 | 18.8 | 0.157 | 54 | 19552 | 163 | 7266921 |
| 16 | L | 1.0 | 50 | 68 | 9 | 23 | 0.63 | 4.2 | 0.021 | 558 | 995 | 21.6 | 0.169 | 52 | 21492 | 168 | 6490865 |
| 17 | L | 1.0 | 50 | 68 | 9 | 23 | 0.52 | 5.8 | 0.018 | 642 | 988 | 19.9 | 0.165 | 47 | 19661 | 163 | 5796751 |
| 18 | M | 1.0 | 50 | 65 | 11 | 24 | 0.65 | 4.2 | 0.022 | 545 | 995 | 21.7 | 0.166 | 46 | 21592 | 165 | 5741919 |
| 19 | N | 1.0 | 50 | 81 | 13 | 6 | 0.48 | 1.0 | 0.009 | 567 | 1066 | 19.9 | 0.190 | 48 | 21213 | 203 | 6736410 |
| 20 | N | 1.0 | 50 | 87 | 11 | 2.0 | 0.45 | 0.4 | 0.007 | 684 | 1079 | 18.2 | 0.151 | 55 | 19638 | 163 | 7879509 |
| 21 | O | 1.0 | 50 | 76 | 8 | 16 | 0.44 | 2.6 | 0.006 | 584 | 1010 | 21.4 | 0.191 | 77 | 21614 | 193 | 9859095 |
| 22 | P | 1.0 | 50 | 76 | 10 | 14 | 0.42 | 2.2 | 0.006 | 537 | 986 | 21.8 | 0.198 | 71 | 21495 | 195 | 8726681 |
| 23 | Q | 1.0 | 50 | 83 | 9 | 8 | 0.44 | 1.4 | 0.007 | 693 | 1059 | 20.2 | 0.178 | 84 | 21392 | 189 | 11657419 |
| 24 | R | 1.0 | 50 | 69 | 12 | 19 | 0.51 | 2.0 | 0.011 | 526 | 995 | 23.0 | 0.215 | 73 | 22885 | 214 | 9112176 |
| 25 | S | 1.0 | 50 | 91 | 9 | 0.0 | 0.58 | — | 0.031 | 671 | 1177 | 15.4 | 0.138 | 63 | 18126 | 162 | 10463104 |

TABLE 12-continued

| Test No. | Steel | Cold-rolled steel sheet thickness (mm) | Cold rolling ratio[1)] (%) | Metallic structure of cold-rolled steel sheet (%: volume ratio): Low-temperature transformation producing phase (%) | Retained austenite (%) | Polygonal α (%) | Average grain size (μm): Retained γ | Average grain size (μm): Polygonal α | $N_R$[2)] (number/μm²) | Mechanical property of cold-rolled steel sheet[3)]: YS (MPa) | TS (MPa) | El (%) | N value | λ (%) | TS × El (MPa %) | TS × n value (MPa) | $TS^{1.7}$ × λ ($MPa^{1.7}$ %) |
|---|---|---|---|---|---|---|---|---|---|---|---|---|---|---|---|---|---|
| 26 | T | 1.2 | 54 | 81 | 14 | 5 | 0.53 | 1.1 | 0.018 | 646 | 1120 | 18.8 | 0.151 | 61 | 21056 | 169 | 9311089 |
| 27 | T | 0.8 | 69 | 81 | 15 | 6 | 0.54 | 1.3 | 0.016 | 632 | 1111 | 20.2 | 0.163 | 55 | 22442 | 181 | 8280882 |

[1)]Cold rolling ratio: Total draft of cold rolling;
[2)]$N_R$: Number density of retained austenite grain having grain size of 1.2 μm or larger;
[3)]El: Total elongation converted so as to correspond to 1.2-mm thickness,
λ: Bore expanding ratio,
n value: work hardening index All of cold-rolled steel sheets produced pursuant to the method defined in the present invention had the value of TS×El being 15,000 MPa % or higher, the value of TS×n value being 150 or higher, and the value of $TS^{1.7}$×λ being 4,500,000 $MPa^{1}$0.7% or higher, exhibiting excellent ductility, work hardening property, and stretch flanging property. All of the example in which the roll draft of the final one pass of hot rolling was higher than 25%, and the secondary cooling stop temperature after annealing was 340° C. or higher had the value of TS×El being 19,000 MPa % or higher, the value of TS×n value being 160 or higher, and the value of $TS^{1.7}$×λ being 5,500,000 $MPa^{1.7}$% or higher, exhibiting further excellent ductility, work hardening property, and stretch flanging property. All of the example in which the roll draft of the final one pass of hot rolling was higher than 25%, the total draft of cold rolling was higher than 50%, the soaking treatment temperature in annealing was ($Ac_3$ point−40° C.) or higher and lower than ($Ac_3$ point+50° C.), after soaking treatment, the steel sheet was cooled by 50° C. or more from the soaking temperature at a cooling rate of lower than 10.0° C./s, and the secondary cooling stop temperature was 340° C. or higher had the value of TS×El being 20,000 MPa % or higher, the value of TS×n value being 165 or higher, and the value of $TS^{1.7}$×λ being 6,000,000 $MPa^{1.7}$% or higher, exhibiting still further excellent ductility, work hardening property, and stretch flanging property.

The invention claimed is:

1. A method for manufacturing a cold-rolled steel sheet having a metallic structure such that the main phase is a low-temperature transformation producing phase, and the secondary phase contains retained austenite, which is more than 6.0% and less than 25.0% in volume ratio with respect to a total structure, characterized by comprising the following steps (C) to (E):

(C) a hot-rolling step in which a slab having a chemical composition consisting, in mass percent, of C: more than 0.020% and less than 0.30%, Si: more than 0.10% and at most 3.00%, Mn: more than 1.00% and at most 3.50%, P: at most 0.10%, S: at most 0.010%, sol.Al: at least 0% and at most 2.00%, N: at most 0.010%, Ti: at least 0% and less than 0.050%, Nb: at least 0% and less than 0.050%, V: at least 0% and at most 0.50%, Cr: at least 0% and at most 1.0%, Mo: at least 0% and at most 0.50%, B: at least 0% and at most 0.010%, Ca: at least 0% and at most 0.010%, Mg: at least 0% and at most 0.010%, REM: at least 0% and at most 0.050%, and Bi: at least 0% and at most 0.050%, the remainder of Fe and impurities, is subjected to hot rolling such that the roll draft of the final one pass is higher than 15%, and rolling is finished in the temperature region of $Ar_3$ point or higher to form a hot-rolled steel sheet, and the hot-rolled steel sheet is cooled to the temperature region of 780° C. or lower within 0.4 seconds after the completion of the rolling, and is coiled in the temperature region of higher than 400° C.;

(D) a cold-rolling step in which the hot-rolled steel sheet obtained by the step (C) is subjected to cold rolling in which a cold rolling ratio is 40% or higher, to form a cold-rolled steel sheet; and (E) an annealing step in which the cold-rolled steel sheet is subjected to soaking treatment in the temperature region of ($Ac_3$ point−40° C.) or higher, thereafter cooled to the temperature region of 500° C. or lower and 300° C. or higher, and is held in that temperature region for 30 seconds or longer.

2. A method for manufacturing a cold-rolled steel sheet having a metallic structure such that the main phase is a low-temperature transformation producing phase, and the secondary phase contains retained austenite, which is more than 6.0% and less than 25.0% in volume ratio with respect to a total structure, characterized by comprising the following steps (F) to (I):

(F) a hot-rolling step in which a slab having a chemical composition consisting, in mass percent, of C: more than 0.020% and less than 0.30%, Si: more than 0.10% and at most 3.00%, Mn: more than 1.00% and at most 3.50%, P: at most 0.10%, S: at most 0.010%, sol.Al: at least 0% and at most 2.00%, N: at most 0.010%, Ti: at least 0% and less than 0.050%, Nb: at least 0% and less than 0.050%, V: at least 0% and at most 0.50%, Cr: at least 0% and at most 1.0%, Mo: at least 0% and at most 0.50%, B: at least 0% and at most 0.010%, Ca: at least 0% and at most 0.010%, Mg: at least 0% and at most 0.010%, REM: at least 0% and at most 0.050%, and Bi: at least 0% and at most 0.050%, the remainder of Fe and impurities, is subjected to hot rolling such that the rolling is finished in the temperature region of $Ar_3$ point or higher to form a hot-rolled steel sheet, and the hot-rolled steel sheet is cooled to the temperature region of 780° C. or lower within 0.4 seconds after the completion of the rolling, and is coiled in the temperature region of lower than 400° C.;

(G) a hot-rolled sheet annealing step in which the hot-rolled steel sheet obtained by the step (F) is subjected to annealing such that the hot-rolled steel sheet is heated to the temperature region of 300° C. or higher to form a hot-rolled and annealed steel sheet;

(H) a cold-rolling step in which the hot-rolled and annealed steel sheet is subjected to cold rolling in which a cold rolling ratio is 40% or higher, to form a cold-rolled steel sheet; and (I) an annealing step in which the cold-rolled steel sheet is subjected to soaking treatment in the temperature region of ($Ac_3$ point−40° C.) or higher, thereafter cooled to the temperature region of 500° C. or lower and 300° C. or higher, and is held in that temperature region for 30 seconds or longer.

3. The method for manufacturing a cold-rolled steel sheet as set forth in claim 1, wherein, in the annealing step (E), the soaking treatment is performed in the temperature region of ($Ac_3$ point−40° C.) or higher and lower than ($Ac_3$ point+50° C.).

4. The method for manufacturing a cold-rolled steel sheet as set forth in claim 2, wherein, in the annealing step (I), the soaking treatment is performed in the temperature region of ($Ac_3$ point−40° C.) or higher and lower than ($Ac_3$ point+50° C.).

5. The method for manufacturing a cold-rolled steel sheet as set forth in claim 1, wherein, in the annealing step (E), the cooling is performed by 50° C. or more at a cooling rate of lower than 10.0° C./s after the soaking treatment.

6. The method for manufacturing a cold-rolled steel sheet as set forth in claim 2, wherein, in the annealing step (I), the cooling is performed by 50° C. or more at a cooling rate of lower than 10.0° C./s after the soaking treatment.

7. The method for manufacturing a cold-rolled steel sheet as set forth in claim 1, wherein, in the metallic structure of the cold-rolled steel sheet, the secondary phase contains retained austenite and polygonal ferrite.

8. The method for manufacturing a cold-rolled steel sheet as set forth in claim 2, wherein, in the metallic structure of the cold-rolled steel sheet, the secondary phase contains retained austenite and polygonal ferrite.

9. The method for manufacturing a cold-rolled steel sheet as set forth in claim 1, wherein the chemical composition contains, in mass percent, one kind or two or more kinds selected from a group consisting of Ti: at least 0.005% and less than 0.050%, Nb: at least 0.005% and less than 0.050%, and V: at least 0.010% and at most 0.50%.

10. The method for manufacturing a cold-rolled steel sheet as set forth in claim 2, wherein the chemical composition contains, in mass percent, one kind or two or more kinds selected from a group consisting of Ti: at least 0.005% and less than 0.050%, Nb: at least 0.005% and less than 0.050%, and V: at least 0.010% and at most 0.50%.

11. The method for manufacturing a cold-rolled steel sheet as set forth in claim 1, wherein the chemical composition contains, in mass percent, one kind or two or more kinds selected from a group consisting of Cr: at least 0.20% and at most 1.0%, Mo: at least 0.05% and at most 0.50%, and B: at least 0.0010% and at most 0.010%.

12. The method for manufacturing a cold-rolled steel sheet as set forth in claim 2, wherein the chemical composition contains, in mass percent, one kind or two or more kinds selected from a group consisting of Cr: at least 0.20% and at most 1.0%, Mo: at least 0.05% and at most 0.50%, and B: at least 0.0010% and at most 0.010%.

13. The method for manufacturing a cold-rolled steel sheet as set forth in claim 1, wherein the chemical composition contains, in mass percent, one kind or two or more kinds selected from a group consisting of Ca: at least 0.0005% and at most 0.010%, Mg: at least 0.0005% and at most 0.010%, REM: at least 0.0005% and at most 0.050%, and Bi: at least 0.0010% and at most 0.050%.

14. The method for manufacturing a cold-rolled steel sheet as set forth in claim 2, wherein the chemical composition contains, in mass percent, one kind or two or more kinds selected from a group consisting of Ca: at least 0.0005% and at most 0.010%, Mg: at least 0.0005% and at most 0.010%, REM: at least 0.0005% and at most 0.050%, and Bi: at least 0.0010% and at most 0.050%.

* * * * *